US009449745B2

(12) United States Patent
Inaba

(10) Patent No.: US 9,449,745 B2
(45) Date of Patent: Sep. 20, 2016

(54) REACTOR, REACTOR-USE COIL COMPONENT, CONVERTER, AND POWER CONVERTER APPARATUS

(71) Applicants: Sumitomo Electric Industries, Ltd., Osaka-shi (JP); Sumitomo Wiring Systems, Ltd., Yokkaichi-shi (JP); AutoNetworks Technologies, Ltd., Yokkaichi-shi (JP)

(72) Inventor: Kazuhiro Inaba, Osaka (JP)

(73) Assignees: Sumitomo Electric Industries, Ltd., Osaka-shi (JP); Sumitomo Wiring Systems, Ltd., Yokkaichi-shi (JP); AutoNetworks Technologies, Ltd., Yokkaichi-shi (JP)

( * ) Notice: Subject to any disclaimer, the term of this patent is extended or adjusted under 35 U.S.C. 154(b) by 33 days.

(21) Appl. No.: 14/350,040

(22) PCT Filed: Sep. 25, 2012

(86) PCT No.: PCT/JP2012/074520

§ 371 (c)(1),
(2) Date: Apr. 4, 2014

(87) PCT Pub. No.: WO2013/051425

PCT Pub. Date: Apr. 11, 2013

(65) Prior Publication Data

US 2014/0232508 A1 Aug. 21, 2014

(30) Foreign Application Priority Data

Oct. 6, 2011 (JP) ..... 2011-222309
Aug. 13, 2012 (JP) ..... 2012-179585

(51) Int. Cl.
*H01F 27/24* (2006.01)
*H01F 17/04* (2006.01)
(Continued)

(52) U.S. Cl.
CPC ..... *H01F 3/08* (2013.01); *H01F 27/022* (2013.01); *H01F 27/255* (2013.01); *H01F 37/00* (2013.01)

(58) Field of Classification Search
CPC ..... H01F 27/022; H01F 2017/048; H01F 41/127; H01F 27/06; H01F 27/327
USPC ..... 336/55, 61, 90, 96, 223, 212, 221
See application file for complete search history.

(56) References Cited

U.S. PATENT DOCUMENTS 2,628,342 A * 2/1953 Taylor ..... H04M 1/02 336/107
3,210,701 A * 10/1965 Fastner ..... H01F 27/022 336/208

(Continued)

FOREIGN PATENT DOCUMENTS

JP 2006-319312 A 11/2006
JP 2008-305854 A 12/2008

(Continued)

OTHER PUBLICATIONS

International Search Report in PCT International Application No. PCT/JP2012/074520, dated Dec. 25, 2012.

*Primary Examiner* — Alexander Talpalatski
*Assistant Examiner* — Joselito Baisa
(74) *Attorney, Agent, or Firm* — Venable LLP; Michael A. Sartori; Laura G. Remus

(57) ABSTRACT

A reactor 1A of the present invention includes a sleeve-like coil 2, a magnetic core 3 disposed inside and outside the sleeve-like coil 2 to form a closed magnetic path, and a case 4A storing the coil 2 and the magnetic core 3. At least part of the magnetic core 3 (herein, an outer core portion 32 provided on the outer circumferential side of the coil 2) is formed by a composite material containing magnetic substance powder and resin. The case 4A is formed by a bottom plate portion 40 and a wall portion 41 each being an independent member. In the reactor 1A, the coil 2 and the bottom plate portion 40 that is made of a non-magnetic metal material are integrally retained by a resin mold portion 21 formed by an insulating resin. Since the resin mold portion 21 fixes the coil 2 and the bottom plate portion 40, the heat of the coil 2 can be efficiently transferred to the installation target. Accordingly, the reactor 1A has an excellent heat dissipating characteristic.

13 Claims, 10 Drawing Sheets

(51) Int. Cl.

| | |
|---|---|
| ***H01F 27/08*** | (2006.01) |
| ***H01F 3/08*** | (2006.01) |
| ***H01F 37/00*** | (2006.01) |
| ***H01F 27/02*** | (2006.01) |
| ***H01F 27/255*** | (2006.01) |

(56) References Cited

U.S. PATENT DOCUMENTS 3,675,174 A * 7/1972 Horbach ..... H01F 41/127 335/299
4,689,592 A * 8/1987 Walker ..... H01F 38/08 336/165
4,754,250 A * 6/1988 Duin ..... 336/65
5,210,513 A * 5/1993 Khan ..... H01F 27/22 336/233
5,469,124 A * 11/1995 O'Donnell ..... H01F 27/06 336/210
5,977,855 A * 11/1999 Matsumura ..... H01F 27/365 336/192
7,130,197 B2 * 10/2006 Chin ..... H01F 27/22 165/80.3
7,164,584 B2 * 1/2007 Walz ..... H01F 27/22 165/185
7,449,986 B2 * 11/2008 Yamaguchi ..... H01F 5/04 336/192
7,782,168 B2 * 8/2010 Nakatsu ..... H01F 3/14 336/145
7,791,887 B2 * 9/2010 Ganev ..... H05K 7/209 361/274.3
8,427,271 B2 * 4/2013 Nakatsu ..... H01F 3/14 336/178
8,653,924 B2 * 2/2014 Kobayashi ..... H01F 27/022 336/196
2010/0209314 A1 * 8/2010 Sato ..... 422/198
2010/0237972 A1 * 9/2010 Yen ..... H01F 27/06 336/65
2011/0012252 A1 * 1/2011 Gao et al. ..... 257/698
2011/0115593 A1 * 5/2011 Liao ..... H01F 27/02 336/90
2011/0156853 A1 * 6/2011 Kato et al. ..... 336/192

FOREIGN PATENT DOCUMENTS

| | | | |
|---|---|---|---|
| JP | 2010-034228 | A | 2/2010 |
| JP | 2010-074150 | A | 4/2010 |
| JP | 2011-124310 | A | 6/2011 |
| WO | WO-2011/089941 | A1 | 7/2011 |

* cited by examiner (A)

(B)

REACTOR, REACTOR-USE COIL COMPONENT, CONVERTER, AND POWER CONVERTER APPARATUS

TECHNICAL FIELD

The present invention relates to a reactor used as a constituent component of an in-vehicle DC-DC converter mounted on a vehicle such as a hybrid vehicle or of a power converter apparatus, a reactor-use coil component, a converter including the reactor, and a power converter apparatus including the converter. In particular, the present invention relates to a reactor with excellent heat dissipating characteristic.

BACKGROUND ART

A reactor is one of the components of a circuit that performs a voltage step up or step down operation. For example, Patent Literature 1 discloses a reactor that is used for a converter mounted on a vehicle such as a hybrid vehicle. The reactor includes a sleeve-like coil, a magnetic core disposed inside and outside the coil, and a bottomed sleeve-like case storing the coil and the magnetic core. Patent Literature 1 discloses the mode in which the portion of the magnetic core that covers the outer circumferential face and end faces of the coil is made of a composite material of magnetic substance powder and resin.

The reactor used as an in-vehicle component is generally used as being fixed to an installation target such as a cooling base, such that the coil and the like that produce heat when being energized are cooled. The case is made of a material exhibiting excellent thermal conductivity, such as aluminum (see paragraph [0039] and others in the specification of Patent Literature 1). The case is fixed such that its outer bottom face is in contact with the installation target, to be used as a heat dissipation path.

CITATION LIST

Patent Literature

Patent Literature 1: Japanese Unexamined Patent Publication No. 2011-124310

SUMMARY OF INVENTION

Technical Problem

It is desired to further enhance the heat dissipating characteristic of a reactor in which at least part of the magnetic core is made of the composite material containing the above-described resin.

The resin contained in the composite material is generally smaller in thermal conductivity than the metal forming the case, and hence its heat dissipating characteristic is poor. Accordingly, in the mode in which the outer circumferential face and end faces of the coil that produces heat when being energized are covered by the composite material, the heat of the coil tends to accumulate. In the situation where a mold product made of the composite material is prepared and the mold product is assembled to the coil, part of the outer circumferential face of the coil can be exposed outside the composite material. However, because of the presence of the resin in the mold product, the heat dissipating characteristic of the mold product is poor as compared to the magnetic core that is substantially made of metal (e.g., a lamination product of electromagnetic steel sheets). Accordingly, it is desired to improve the heat dissipating characteristic also in the situation where the mold product made of the composite material is included.

In order to improve the heat dissipating characteristic, for example, the coil may be stored in the case such that the axis of the coil becomes parallel to the outer bottom face of the case, which is in contact with the installation target such as a cooling base. With this storage mode (hereinafter referred to as the horizontal storage mode), as compared to the mode in which the coil is stored in the case such that the axis of the coil becomes perpendicular to the outer bottom face of the case (hereinafter this storage mode is referred to as the vertical storage mode), the region in which the distance to the installation target is short becomes greater in the outer circumferential face of the coil. Thus, the heat dissipating characteristic can be enhanced.

However, when the coil is in a shape with a curved surface such as a cylindrical shape, though the coil can be formed with ease, it is difficult to dispose the coil in the case in a stable manner, particularly in the horizontal storage mode. When the coil is disposed in an unstable manner, an improvement in the heat dissipating characteristic may not be fully achieved. Further, in the horizontal storage mode, since it is difficult to dispose the coil in a stable manner, a reduction in productivity of the reactor is invited.

Accordingly, an object of the present invention is to provide a reactor with an excellent heat dissipating characteristic. Further, another object of the present invention is to provide a reactor-use coil component with which a reactor with an excellent heat dissipating characteristic can be obtained. Still further, still another object of the present invention is to provide a converter including a reactor with an excellent heat dissipating characteristic, and a power converter apparatus including the converter.

Solution to Problem

The present invention achieves the objects by designing a bottom plate portion and a wall portion that structure a case to each be an independent member, and allowing the bottom plate portion and the coil to be integrally retained by resin.

The reactor of the present invention is a reactor including: a sleeve-like coil; a magnetic core that is disposed inside and outside the coil to form a closed magnetic path; and a case that stores the coil and the magnetic core. At least part of the magnetic core is formed by a composite material that contains magnetic substance powder and resin. The case includes a bottom plate portion that is formed by a non-magnetic metal material, an assembled product made up of the coil and the magnetic core being disposed on the bottom plate portion; and a wall portion that is an independent member from the bottom plate portion, the wall portion being attached to the bottom plate portion to surround the assembled product. The reactor of the present invention further comprising: a resin mold portion formed by an insulating resin, the resin mold portion covering at least part of an outer circumference of the coil to retain a shape of the coil and to integrally retain the coil and the bottom plate portion.

With the reactor of the present invention, the bottom plate portion formed by a metal material generally exhibiting excellent thermal conductivity is integrated with the coil by the resin mold portion. Therefore, as compared to the situation where the coil is directly disposed on the bottom portion of the case, the disposition state of the coil relative to the bottom plate portion is stable. Accordingly, with the reactor of the present invention, the heat of the coil is easily transferred to the bottom plate portion, and the heat of the coil is efficiently transferred to the installation target with which the bottom plate portion is brought into contact. Thus, an excellent heat dissipating characteristic is obtained.

Further, with the reactor of the present invention, thanks to the resin mold portion, the following advantages are obtained. (1) The shape of the coil can be maintained, whereby the coil is not expanded or compressed during assembly and hence the coil can be handled with ease. (2) Since the coil and the bottom plate portion are integrated, by structuring the case by assembling the bottom plate portion and the wall portion with each other, the state where the coil is stored in the case can be attained. Hence, it is not necessary to put the coil being a heavy item from the opening portion of the wall portion, whereby the storing work is facilitated. Further, employing injection molding or the like, the resin mold portion can be molded with ease even in a complicated shape, i.e., covering at least part of the outer circumference of the coil and integrating with the bottom plate portion. In addition, the position of the coil relative to the bottom plate portion is prevented from shifting during assembly of the reactor. Thus, the reactor can be manufactured precisely. For example, when the composite material is formed by cast molding using the case as a mold assembly, the position of the coil will not shift in the case while the mixture as the composite material is packed into the case. Further, by forming the bottom plate portion into an appropriate shape, the heat of the coil can be efficiently transferred to the bottom plate portion, whereby the heat dissipating characteristic can be enhanced. In the present invention, in the manufacturing step of the reactor, since the bottom plate portion and the wall portion are each an independent member, the bottom plate portion can be molded into any shape, e.g., with a groove conforming to the shape of the coil. Accordingly, as compared to the conventional situation in which a fitting groove conforming to the shape of the coil is formed at the inner bottom face of the case including the integrally molded bottom portion and wall portion, the constituent component of the case can be manufactured into a desired shape with ease. Thanks to these points, the reactor of the present invention exhibits excellent productivity also.

In addition, since the resin mold portion is made of an insulating resin, insulation between the coil and the magnetic core or insulation between the coil and the bottom plate portion can be enhanced by the insulating resin interposed between the coil and the magnetic core or between the coil and the bottom plate portion.

As a constituent component of the reactor of the present invention, the following reactor-use coil component of the present invention can be suitably used. The reactor-use coil component of the present invention is used as a constituent component of a reactor, which includes a sleeve-like coil, a magnetic core disposed inside and outside the coil to form a closed magnetic path, and a case storing the coil and the magnetic core. The reactor-use coil component is structured by a sleeve-like coil, a bottom plate portion that is made of a non-magnetic metal material and on which an assembled product of the coil and the magnetic core is disposed in the case, and a resin mold portion that is made of an insulating resin. The resin mold portion covers at least part of the outer circumference of the coil to retain the shape of the coil, and integrally retains the coil and the bottom plate portion. Note that, in the reactor, at least part of the magnetic core is made of a composite material containing magnetic substance powder and resin. Further, to the bottom plate portion of the case, a wall portion that is an independent member from the bottom plate portion and that surrounds the assembled product is attached.

As described above, the reactor-use coil component of the present invention integrates the bottom plate portion with excellent thermal conductivity and the coil by the resin mold portion. With this structure, employing the reactor-use coil component of the present invention as a constituent element of a reactor, a reactor with an excellent heat dissipating characteristic can be obtained. Further, as described above, since the reactor-use coil component of the present invention can be handled with ease and also exhibits excellent assemblability, it can also contribute toward improving the productivity of the reactor with an excellent heat dissipating characteristic.

According to one aspect of the reactor of the present invention, the coil includes a juxtaposed pair of sleeve-like coil elements, and the magnetic core is formed by the composite material. Further, as one mode of the reactor-use coil component of the present invention, the magnetic core may be used for a reactor made of the composite material, and the coil includes a juxtaposed pair of sleeve-like coil elements.

In the mode noted above, since a pair of coil elements is included, the length of the coil in the axial direction can be shortened even when the number of turns is great, and a reduction in size can be achieved. Further, in the foregoing mode, though the entire magnetic core is formed by the composite material, the state in which the coil and the bottom plate portion are disposed in close proximity to each other is retained by the resin forming the resin mold portion. Therefore, an excellent heat dissipating characteristic is obtained. Further, in the mode noted above, a magnetic core of various magnetic characteristics can be easily manufactured by varying the type or content of the magnetic substance powder, and there is great flexibility in the shape of the magnetic core.

According to one aspect of the reactor of the present invention, the coil includes the sleeve-like coil element by one in number, and in the magnetic core, at least part of a portion disposed on an outer circumferential side of the coil element is formed by the composite material, and in the outer circumference of the coil element, a portion covered by the composite material is covered by the resin forming the resin mold portion. Further, as one mode of the reactor-use coil component of the present invention, the coil may include the sleeve-like coil element by one in number. In the outer circumference of the coil element, the portion covered by the composite material is covered by the resin forming the resin mold portion. This reactor-use coil component is used for a reactor in which, in the magnetic core, at least part of the portion disposed on the outer circumferential side of the coil element is made of the composite material.

The mode noted above can provide a reactor being small in size, because the coil element is included by one in number. Further, in this mode, though at least part of the outer circumference of the coil is covered by the composite material, the state in which the coil and the bottom plate portion are disposed in close proximity to each other is retained by the resin forming the resin mold portion. Thus, an excellent heat dissipating characteristic is obtained.

As one mode of the reactor of the present invention and the reactor-use coil component of the present invention, at least part of a region where the bottom plate portion is covered by the resin mold portion may be subjected to a surface roughening treatment.

By the surface roughening treatment, the contact area between the bottom plate portion and the resin forming the resin mold portion is increased, whereby adhesion between them can be enhanced. Accordingly, in this mode, the coil and the bottom plate portion can be strongly joined to each other via the resin forming the resin mold portion, whereby the heat of the coil can be easily transferred to the bottom plate portion, and an excellent heat dissipating characteristic can be obtained. Further, also because of the fact that the surface area of the bottom plate portion itself is great as a result of the surface roughening treatment, this mode provides an excellent heat dissipating characteristic.

As one mode of the reactor of the present invention and the reactor-use coil component of the present invention, the bottom plate portion may include a heat dissipating pedestal portion that is provided with a supporting face conforming to the outer circumferential face of the coil.

By the supporting face, the greater area of the outer circumferential face of the coil is disposed in close proximity to the bottom plate portion. Thus, the heat of the coil can be efficiently transferred by the bottom plate portion. Accordingly, this mode provides an excellent heat dissipating characteristic. Further, since the resin forming the resin mold portion is present by a uniform thickness between the outer circumferential face of the coil and the supporting face of the heat dissipating pedestal portion, this mode also provides an excellent insulation performance.

As one mode of the reactor of the present invention, the reactor includes a lid portion that covers an opening portion of the wall portion; and a lid-side pedestal portion that is formed by a non-magnetic metal material and that is integrally retained with the coil by the resin forming the resin mold portion, the lid portion being attached to the lid-side pedestal portion. Further, as one mode of the reactor-use coil component of the present invention, a lid-side pedestal portion may be included. The lid-side pedestal portion may be made of a non-magnetic metal material and integrally retained with the coil by the resin forming the resin mold portion. To the lid-side pedestal portion, a lid portion covering an opening portion of the wall portion structuring the case may be attached.

In the mode noted above, the lid-side pedestal portion and the lid portion also can be used as the heat dissipation path, and a further excellent heat dissipating characteristic can be obtained. Further, since the opening portion of the wall portion is covered by the lid portion, protection from the external environment and mechanical protection of the stored item in the case can be achieved.

As one mode of the reactor of the present invention, the case includes the lid portion that is integrally molded with the wall portion.

In the mode noted above, since the wall portion and the lid portion are integrated, the work of attaching the lid portion can be dispensed with, and an excellent assemblability is exhibited. Further, since the lid portion is included, an improvement in the heat dissipating characteristic or protection of the stored item in the case can be achieved.

According to one aspect of the reactor of the present invention, in the magnetic core, an inner core portion disposed inside the coil is integrally retained with the coil by the resin forming the resin mold portion. Further, as one mode of the reactor-use coil component of the present invention, in the magnetic core included in the reactor, an inner core portion disposed inside the coil may be integrally retained with the coil by the resin forming the resin mold portion.

In the mode noted above, since part of the magnetic core, in addition to the coil, is integrated by the resin mold portion, excellent assemblability of the reactor is achieved.

As one mode of the reactor of the present invention, the coil may be stored in the case such that the axis of the coil is parallel to the outer bottom face of the bottom plate portion. Further, as one mode of the reactor-use coil component of the present invention, the coil may be attached to the outer bottom face of the bottom plate portion such that the axis of the coil is paralleled.

In the mode noted above, the reactor in the horizontal storage mode can be structured. In the outer circumferential face of the coil, the region where the distance to the installation target is short can be fully widely secured. Thus, an excellent heat dissipating characteristic is achieved.

As one mode of the reactor of the present invention, the case may integrally include an attaching portion for fixing the reactor to an installation target. Further, as one mode of the reactor-use coil component of the present invention, the bottom plate portion may integrally include an attaching portion for fixing the reactor to an installation target.

In the mode noted above, using a fixing member such as a bolt, the reactor can be easily attached to the installation target.

The converter of the present invention includes the reactor of the present invention. The power converter apparatus of the present invention includes the converter of the present invention.

The converter of the present invention or the power converter apparatus of the present invention includes the reactor of the present invention exhibiting an excellent heat dissipating characteristic. Accordingly, the converter of the present invention or the power converter apparatus of the present invention has an excellent heat dissipating characteristic, and can be used as an in-vehicle component, particularly a constituent component of a converter or as a constituent component of a power converter apparatus.

Advantageous Effects of Invention

The reactor of the present invention has an excellent heat dissipating characteristic. With the reactor-use coil component of the present invention, a reactor with an excellent heat dissipating characteristic can be obtained.

BRIEF DESCRIPTION OF DRAWINGS

FIG. 1 (B) is a cross sectional view taken along (B)-(B) in FIG. 1 (A).

DESCRIPTION OF EMBODIMENTS

In the following, a specific description will be given of embodiments of the present invention with reference to the drawings. Throughout the drawings, identical reference signs denote identically named elements.

[First Embodiment]

Figure 1:
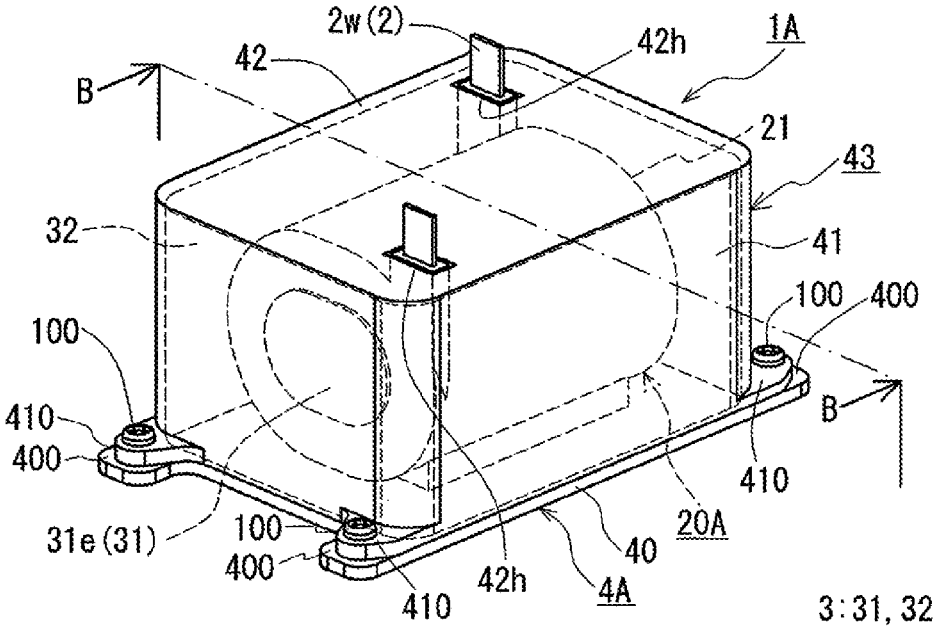
FIG. 1 (A) is a schematic perspective view of a reactor according to a first embodiment.
Figure 1:
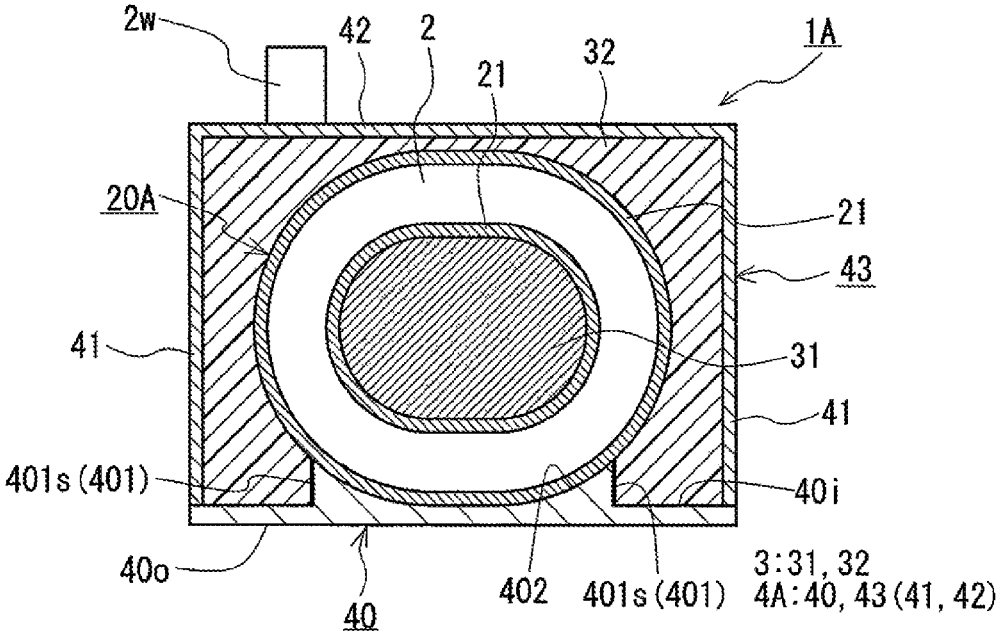
Figure 2:
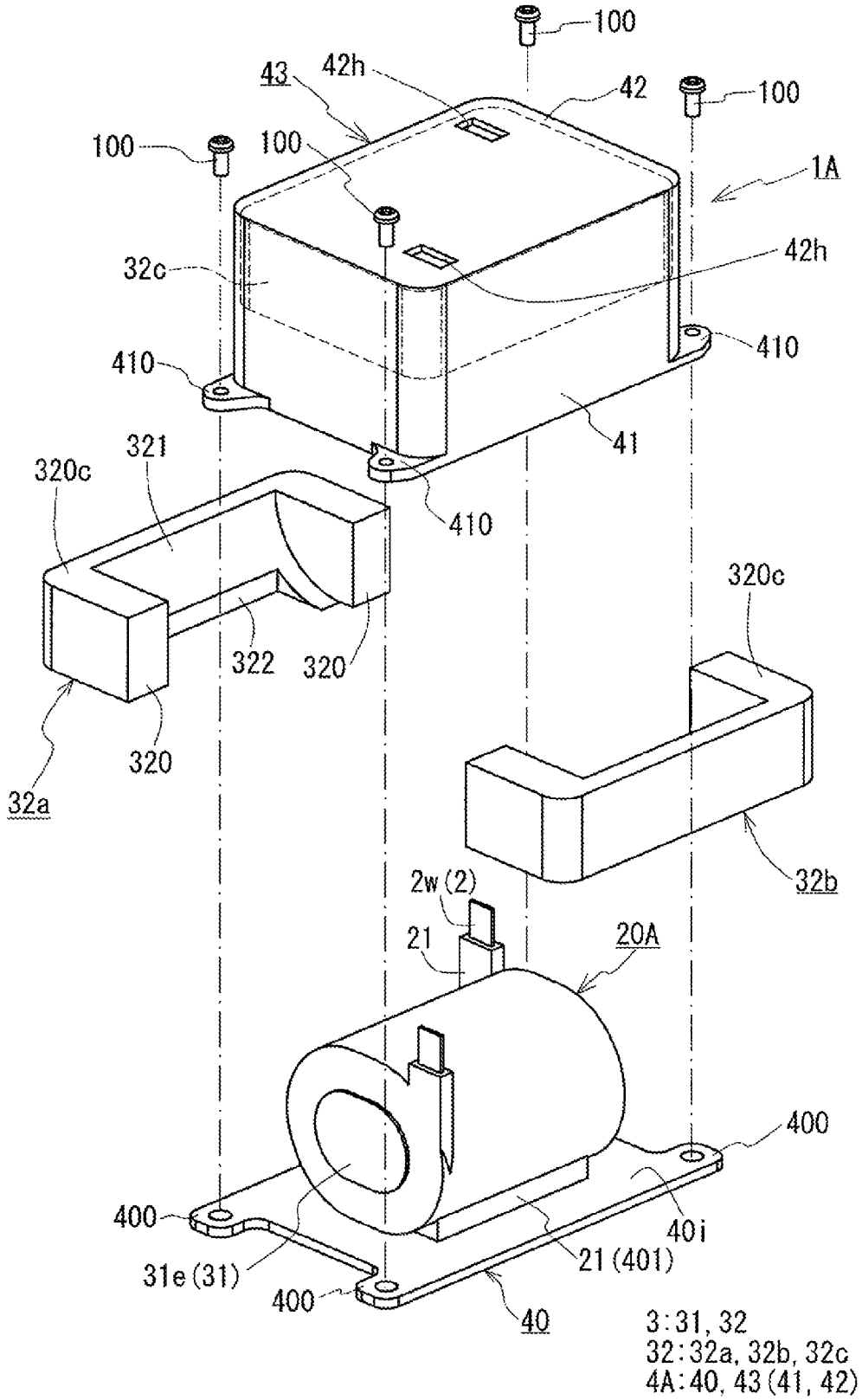
FIG. 2 is an exploded perspective view of the reactor according to the first embodiment.
Figure 3:
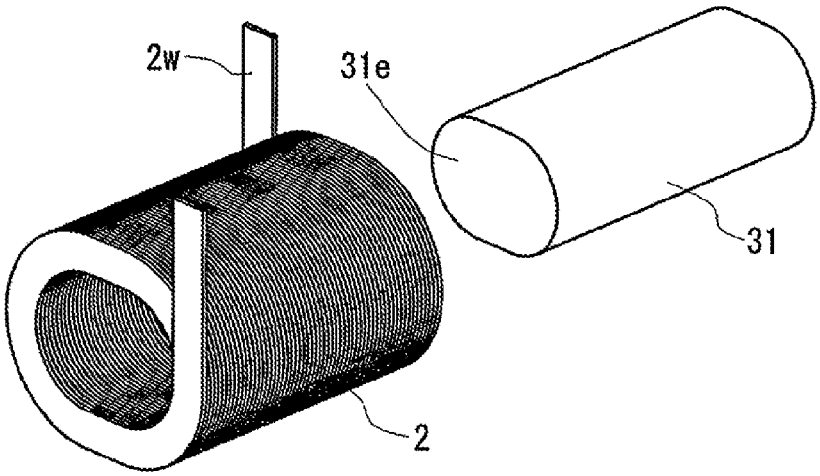
FIG. 3 is a schematic perspective view of a constituent member retained by a resin mold portion in a coil component included in the reactor according to the first embodiment.
Figure 3:
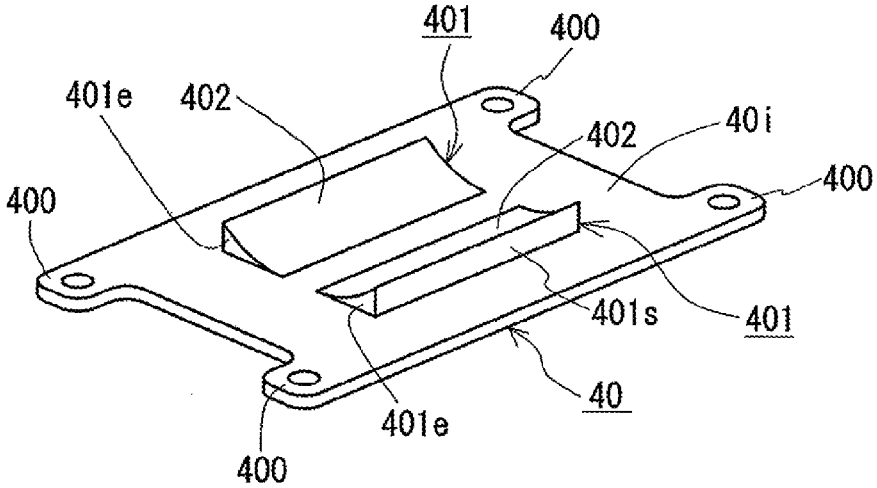

With reference to FIGS. 1 to 3, a description will be given of a reactor 1A according to a first embodiment. The reactor 1A includes a coil 2 mainly made of one sleeve-like coil element made of a spirally wound wire 2*w*, and a magnetic core 3 disposed inside and outside the coil 2 to form a closed magnetic path. The coil 2 and the magnetic core 3 are stored in a case 4A. Representatively, the reactor 1A is used having the case 4A installed on an installation target such as a cooling base. The magnetic core 3 includes a columnar inner core portion 31 disposed in the coil 2, and an outer core portion 32 disposed on the outer circumferential side of the coil 2. Herein, the outer core portion 32 is made of a composite material containing magnetic substance powder and resin. The reactor 1A is characterized in that a bottom plate portion 40 and a wall portion 41 that structure the case 4A are not integrally molded, but are each an independent member. The reactor 1A is further characterized in including a coil component 20A in which the coil 2 and the bottom plate portion 40 are integrally retained by a resin mold portion 21. In the following, a detailed description will be given of each structure.

(Coil Component)

A description will be given of the coil component 20A with reference to FIGS. 2 and 3. The coil component 20A included in the reactor 1A according to the first embodiment includes the coil 2, the bottom plate portion 40 structuring the case 4A, the inner core portion 31 structuring the magnetic core 3, and the resin mold portion 21 that integrally retains them.

<Coil>

The coil 2 includes a sleeve-like coil element structured by a plurality of turns formed by one continuous wire 2*w* being spirally wound. The wire 2*w* is suitably a coated wire that includes a conductor made of a conductive material such as copper, aluminum, or alloy thereof. The conductor is provided with an insulating coat made of an insulating material (representatively, an enamel material such as polyamide-imide) around its outer circumference. The conductor may be of a variety of shape, such as a rectangular wire whose cross-sectional shape is rectangular, a round wire whose cross-sectional shape is circular, or a deformed wire whose cross-sectional shape is polygonal. Herein, the coil (coil element) 2 is an edgewise coil formed by a coated rectangular wire being wound edgewise, in which the conductor is a rectangular wire made of copper, and the insulating coat is made of enamel. The edgewise coil can increase the space factor to form a compact coil, and contributes toward reducing the size of the reactor.

The end face shape of the coil (coil element) 2 can be selected as appropriate. Herein, the end face is in a racetrack shape formed by a combination of straight lines and arcs, and at least part of the outer circumferential face of the coil 2 is formed by a flat surface. Herein, the reactor 1A according to the first embodiment is in the horizontal storage mode in which the coil 2 is stored in the case 4A such that the axis of the coil 2 becomes parallel to an outer bottom face 40*o* (FIG. 1 (B)) formed by a flat surface in the case 4A. In the horizontal storage mode, since the flat surface of the outer circumferential face of the coil 2 is disposed in parallel to the outer bottom face 40*o* of the case 4, the region in which the distance from the outer circumferential face of the coil 2 to the outer bottom face 40*o* is short can be increased. Thus, the heat dissipating characteristic can be enhanced. Accordingly, in the horizontal storage mode, the coil in which at least part of its outer circumferential face is formed by a flat surface, such as the aforementioned racetrack shape, is preferable. Other suitable shape may include, for example, a coil whose end faces are each a polygon (e.g., a rectangle) having corner portions rounded (see FIG. 7 whose description will follow). On the other hand, when the end face shape of the coil 2 is substantially solely made of a curve, such as a circle or an ellipse, the wire can easily be wound even when the wire is a rectangular wire, and hence excellent manufacturability of the coil is exhibited. Even with the cylindrical coil, since the coil is fixed to the bottom plate portion 40 by the resin mold portion 21, the position of the coil 2 relative to the bottom plate portion 40 can be stably maintained during assembly of the reactor.

In connection with the wire 2*w* forming the coil 2, the region in each end portion side is drawn out as appropriate from the turn portion as shown in FIG. 3, and a terminal member (not shown) made of a conductive material such as copper or aluminum is connected thereto. Via the terminal member, the coil 2 is supplied with power. The draw-out direction of the opposite end portions of the wire 2*w* can be selected as appropriate. Herein, the opposite end portions of the wire 2*w* are drawn out respectively at one end side and other end side of the coil 2. However, it is possible to employ the mode in which the region on one end portion side of the wire 2*w* is appropriately folded back toward other end side of the coil 2, such that the opposite end portions of the wire 2*w* are disposed on one end side of the coil 2. Note that, though the opposite end portions of the wire 2*w* are representatively exposed outside the case 4A, they may be stored in the case 4A.

In the coil 2, in some cases, high voltages may be applied to the drawn out portions of the wire 2*w* extended from the turn portion, as compared to the turn portion. Accordingly, when an insulating substance is disposed at least at a portion in each drawn out portion of the wire 2*w* being brought into contact with the magnetic core 3 (the outer core portion 32), insulation between the coil 2 and the magnetic core 3 (in particular, the outer core portion 32) can be enhanced. Herein, as shown in FIGS. 1 and 2, the drawn out portions of the wire 2*w* are covered by the resin mold portion 21. In other mode, an insulating paper, an insulating tape (e.g., a polyimide tape), or an insulating film (e.g., polyimide film) may be wrapped around as appropriate; an insulating material may be dip-coated; or an insulating tubing (any of a heat shrink tubing and a cold shrink tubing) may be disposed. In the mode in which the drawn out portions of the wire 2*w* are not covered by the resin mold portion, since the outer shape of the resin mold portion can be simplified, the coil component can be molded with ease. In the mode in which the drawn out portions of the wire 2*w* are covered by the resin mold portion, it is not necessary to separately dispose an insulating substance, and a reduction in the number of steps can be achieved.

<Inner Core Portion>

As shown in FIG. 3, the inner core portion 31 inserted and disposed inside the coil 2 is a columnar element having an outer shape that conforms to the inner circumferential shape of the coil 2. Herein, the inner core portion 31 is formed by a powder magnetic core in which soft magnetic metal powder is used. Details thereof will be given later.

<Bottom Plate Portion>

The bottom plate portion 40 is a plate-like member that structures part of the case 4A, and that functions as a heat dissipation path while supporting the coil 2. When the reactor 1A is disposed on the installation target such as a cooling base, the outer bottom face 40*o* (FIG. 1 (B)) of the bottom plate portion 40 is disposed so as to be in contact with the installation target, and an assembled product made up of the coil 2 and the magnetic core 3 is disposed on the face being opposite thereto, i.e., an inner bottom face 40*i*. Further, the wall portion 41, whose description will follow, is attached to the periphery portion of the inner bottom face 40*i*. Details of the case 4A will be given later. Then, the bottom plate portion 40 is disposed to cover part of the surface of the coil 2, and this disposition state is retained by the resin mold portion 21.

Since the bottom plate portion 40 is disposed in close proximity to the coil 2, it should be made of a non-magnetic material. Further, since the bottom plate portion 40 is used as the heat dissipation path of the coil 2, it should be made of a metal material which generally exhibits excellent thermal conductivity. The constituent material of the bottom plate portion 40 may include, for example, aluminum, aluminum alloy, magnesium, and magnesium alloy. Since the non-magnetic metals noted herein are lightweight, they are suitable as the constituent material of an in-vehicle component which is desired to be lightweight. Since the bottom plate portion 40 is made of metal, the bottom plate portion 40 in a desired shape can be easily manufactured by casting, cutting work, plastic work and the like. Herein, the bottom plate portion 40 is made of aluminum alloy.

As shown in FIG. 3, the bottom plate portion 40 is a quadrangular plate-like member whose front and back surfaces, i.e., the inner bottom face 40*i* and the outer bottom face 40*o* (FIG. 1 (B)), are each formed by a flat surface. Heat dissipating pedestal portions 401 are integrally molded with the bottom plate portion 40, at places in the inner bottom face 40*i* where the coil 2 is disposed. Herein, two heat dissipating pedestal portions 401 are provided. Each of the heat dissipating pedestal portions 401 is disposed so as to conform to the outer circumferential face of the coil 2 over the entire length of the coil (coil element) 2, and includes a supporting face 402 in a shape conforming to the outer circumferential face of the coil 2. The supporting face 402 is formed by a curved surface conforming to the outer circumferential face of the racetrack-shaped coil 2, and has an area enough to cover part of the outer circumferential face of the coil 2, which is herein the curved surface of the installation side (the bottom side in FIG. 3) region. Each of the heat dissipating pedestal portions 401 is formed by, in addition to the supporting face 402, a pair of end faces 401*e* that is continuous to the supporting face 402 and that is parallel to the end faces of the coil 2, and a side face 401*s* that is continuous to the supporting face 402 and the opposite end faces 401*e* and that is parallel to the axis of the coil 2. The opposite end faces 401*e* and the side face 401*s* are each formed by a flat surface. The heat dissipating pedestal portions 401 are provided such that their respective supporting faces 402 oppose to each other, and such that an interval is formed between the edges of respective supporting faces 402 leading to the inner bottom face 40*i*. The flat surface of the outer circumferential face of the racetrack-shaped coil 2 is disposed in parallel to the flat surface interposed between the heat dissipating pedestal portions 401 in the inner bottom face 40*i*.

Since the outer circumference of the coil 2 is substantially entirely covered by the resin mold portion 21 whose description will be given later, the resin forming the resin mold portion 21 is interposed between the coil 2 and the bottom plate portion 40. Accordingly, insulation between the coil 2 and the bottom plate portion 40 which are mainly made of a metal material can be enhanced. Herein, the supporting face 402 of each of the heat dissipating pedestal portions 401 conforms to the outer circumferential face of the coil 2, and the two heat dissipating pedestal portions 401 are provided to conform to the outer circumferential face of the coil 2. Accordingly, the resin forming the resin mold portion 21 is present by a uniform thickness between the coil 2 and the bottom plate portion 40 (FIG. 1 (B)).

It is preferable to subject at least part of the surface of the bottom plate portion 40, particularly the region covered by the resin mold portion 21 whose description will be given later, to surface roughening treatment, because adhesion between the bottom plate portion 40 and the resin forming the resin mold portion 21 can be enhanced. In particular, in order to enhance adhesion between the coil 2 and the bottom plate portion 40, it is preferable that the region covering the outer circumferential face of the coil 2 in the bottom plate portion 40, i.e., at least part of the supporting faces 402 and part of the inner bottom face 40*i* (the flat surface between the two heat dissipating pedestal portions 401) is subjected to surface roughening treatment.

The surface roughening treatment may include, for example, a process of providing minor concave and convex whose maximum height is 1 mm or less, preferably 0.5 mm or less. Specifically, known schemes for enhancing adhesion between metal and resin can be employed, such as: (1) anodic oxidation treatment represented by aluminum anodizing; (2) acicular plating by any known scheme; (3) implanting a molecular junction compound by any known scheme; (4) fine groove work by laser; (5) nano-order dimple formation using any known special solution; (6) etching process; (7) sand blasting or shot blasting; (8) filing; (9) delustering treatment by sodium hydroxide; and (10) abrasion by a wire brush. An increase in the surface area by such surface roughening is expected to improve the heat dissipating characteristic also.

Further, an increase in the surface area of the bottom plate portion 40 may be achieved also by forming any groove (not shown) or hole (not shown) by a general metal cutting work, or by shaping the surface into a concave-convex shape by casting or plastic work. Thus, an improvement in adhesion or the heat dissipating characteristic attributed to an increase in the contact area between the bottom plate portion 40 and the resin forming the resin mold portion 21 can be expected.

As the region covered by the resin mold portion 21 in the bottom plate portion 40 is greater, adhesion between the bottom plate portion 40 and the resin mold portion 21 can be enhanced. As a result, the bottom plate portion 40 and also the coil 2 are strongly retained by the resin mold portion 21. Herein, in the bottom plate portion 40, the heat dissipating pedestal portions 401 (the supporting faces 402, the end faces 401*e*, and the side faces 401*s*) are covered by the resin mold portion 21, while the region other than the heat dissipating pedestal portions 401 in the inner bottom face 40*i*, the side faces, and the outer bottom faces 40*o* (FIG. 1 (B)) are not covered by the resin mold portion 21 but exposed. Since the outer bottom face 40*o* is exposed outside the resin mold portion 21, the heat of the coil 2 can be easily transferred from the heat dissipating pedestal portions 401 to the installation target, and an excellent heat dissipating characteristic is obtained. In other possible modes, part of or all the end faces 401*e* and the side faces 401*s* may be exposed outside the resin mold portion 21, or the entire surface of the inner bottom face 40*i* may be covered by the resin mold portion 21.

<Resin Mold Portion>

The resin mold portion 21 covers at least part of the surface of the coil 2 and retains the coil 2 in a certain shape. Therefore, the coil 2 is not expanded or compressed thanks to the resin mold portion 21, and hence can be handled with ease during assembly. Further, herein, the resin mold portion 21 also functions to retain the coil 2 in a compressed state than its natural length. Accordingly, the length of the coil 2 is shorter than its natural length, and the coil 2 is small in size. Further, the resin mold portion 21 also has a function of enhancing insulation between the coil 2 and the surrounding members (the magnetic core 3, the bottom plate portion 40 (particularly the heat dissipating pedestal portions 401 and the inner bottom face 40*i*)), because the resin mold portion 21 is made of an insulating resin and covers the surface of the coil 2. The resin mold portion 21 also functions as a member that integrally retains the coil 2 and the bottom plate portion 40. Furthermore, in the reactor 1A according to the first embodiment, the resin mold portion 21 integrally retains the coil 2, the bottom plate portion 40, and the inner core portion 31. Accordingly, since the reactor 1A employs such a coil component 20A, the number of assembled components is small and excellent assemblability is exhibited.

Herein, the resin mold portion 21 covers, in the assembled product made up of the coil 2, the inner core portion 31 inserted and disposed inside the coil 2, and the bottom plate portion 40 including the heat dissipating pedestal portions 401 provided to cover part of the outer circumferential face of the coil 2, the portions except for the opposite end portions of the wire 2*w* to which the terminal members are connected, and the heat dissipating pedestal portions 401 in the inner bottom face 40*i* of the bottom plate portion 40. That is, the resin mold portion 21 covers the inner circumferential face, the outer circumferential face, a pair of end faces, and part of the drawn out portions of the wire 2*w* of the coil 2. The entire outer circumferential face of the inner core portion 31 is covered by the resin mold portion 21. In the bottom plate portion 40, the supporting faces 402, the side faces 401*s*, and the end faces 401*e* of the heat dissipating pedestal portions 401 are entirely covered by the resin mold portion 21.

The area covered by the resin mold portion 21 can be selected as appropriate. For example, part of the turn portion of the coil 2 may not be covered by the resin mold portion 21 and may be exposed outside. Specifically, even when the resin forming the resin mold portion 21 is interposed only between the coil 2 and the bottom plate portion 40, maintenance of the shape of the coil 2 and insulation between the coil 2 and the bottom plate portion 40 can be achieved. Alternatively, of the outer circumference of the coil 2, when at least the portion covered by the composite material forming the outer core portion 32 is covered by the resin forming the resin mold portion 21, maintenance of the shape of the coil 2 and insulation between the coil 2 and the magnetic core 3 (the outer core portion 32) can be achieved. However, as in the present embodiment, when the coil 2 is substantially entirely covered, the resin forming the resin mold portion 21 is interposed between the coil 2 and the magnetic core 3, and between the coil 2 and the bottom plate portion 40. Therefore, insulation between the coil 2 and the magnetic core 3 and between the coil 2 and the bottom plate portion 40 can be enhanced. Further, as the region of the coil 2 covered by the resin mold portion 21 is greater, the shape of the coil 2 can be retained easier.

Herein, though the opposite end faces 31*e* of the inner core portion 31 and the nearby area of the opposite end faces 31*e* are not covered by the resin mold portion 21 and exposed outside, to be brought into contact with the composite material forming the outer core portion 32 whose description will follow, it is possible to employ the mode in which at least one end face 31*e* is covered by the resin mold portion 21. At this time, the resin on the end face 31*e* of the inner core portion 31 can be used as a gap.

The thickness of the resin mold portion 21 can be selected as appropriate, e.g., about 0.1 mm to 10 mm. As the thickness of the resin mold portion 21 is greater, the insulation performance can be enhanced; as the thickness is smaller, the heat dissipating characteristic can be enhanced, and moreover, a reduction in size of the coil component can be achieved. When the small thickness is employed, the thickness is preferably about 0.1 mm to 3 mm, and should be selected as appropriate within a range satisfying desired insulating strength and the like. Further, the thickness may be uniform over the entire covered portion, or may be partially varied. For example, as shown in FIG. 1 (B), when the thickness of the portion in the resin mold portion 21 covering the side faces 401*s* and the end faces 401*e* (FIG. 3) of the heat dissipating pedestal portions 401 is relatively small, while the thickness of the portion covering the coil 2 is relatively great, insulation between the coil 2 and the magnetic core 3 and insulation between the coil 2 and the heat dissipating pedestal portions 401 can be effectively enhanced. Herein, the thickness of the portion in the resin mold portion 21 covering the surface of the coil 2 is set to be uniform, and the thickness of the portions covering the side faces 401*s* and the end faces 401*e* of the heat dissipating pedestal portions 401 are also set to be uniform though the thickness is small. Accordingly, the outer shape of the coil component 20A is in a similar shape as the assembled product made up of the coil 2, the inner core portion 31, and the bottom plate portion 40 including the heat dissipating pedestal portions 401. Note that, the coil 2 and the inner core portion 31 are coaxially disposed by the resin forming the resin mold portion 21 interposed between the coil 2 and the inner core portion 31.

As the insulating resin that forms the resin mold portion 21, what is preferably used is any resin that has the insulating characteristic with which the coil 2 and the magnetic core 3, and the coil 2 and the bottom plate portion 40 (particularly heat dissipating pedestal portion 401 and inner bottom face 40*i*) can be fully insulated from each other, and the heat resistance with which the resin does not soften when the maximum temperature is reached during operation of the reactor 1A. Further, the resin should be capable of being subjected to transfer molding or injection molding. For example, thermosetting resin such as epoxy resin, silicone resin, and unsaturated polyester, or thermoplastic resin such as polyphenylene sulfide (PPS) resin and liquid crystal polymer (LCP) can be suitably used. When a mixture of the resin and a filler made of at least one type of ceramic selected from silicon nitride, alumina, aluminum nitride, boron nitride, and silicon carbide is used for the resin mold portion 21, insulation performance can be improved, and the heat dissipating characteristic can also be improved. In particular, when the resin whose thermal conductivity is 1 W/m·K or more, furthermore 2 W/m·K or more, is used for the resin mold portion 21, an excellent heat dissipating characteristic can be obtained and hence is preferable. Herein, for the resin mold portion 21, epoxy resin (thermal conductivity: 2 W/m·K) containing a filler is used.

In manufacturing the coil component 20A, for example, a manufacturing method disclosed in Japanese Unexamined Patent Publication No. 2009-218293 can be used. The coil component 20A can be manufactured by various molding methods such as injection molding, transfer molding, cast molding and the like. More specifically, by storing the coil 2, the inner core portion 31, and the bottom plate portion 40 in a mold assembly, and disposing any appropriate support member such that the foregoing elements are covered by resin by a desired thickness. Thus, the resin mold portion 21 can be molded and the coil component 20A can be manufactured.

The coil 2 may be joined to the bottom plate portion 40 by an insulating adhesive agent (which may be sheet-like), and the resin mold portion 21 may be formed at the resultant joined product. In this situation, it is not necessary to carry out positioning of the coil 2 and the bottom plate portion 40 relative to the mold assembly or to maintain the position of them, and hence excellent moldability is exhibited. According to this manufacturing method, a coil component in which the insulating adhesive agent is at least partially interposed between the coil 2 and the bottom plate portion 40. Accordingly, the present invention includes the mode in which the resin forming the resin mold portion 21 is not interposed between the coil 2 and the bottom plate portion 40, and only the insulating adhesive agent is interposed. The insulating adhesive agent may be epoxy resin, acrylic resin or the like, or those containing the filler made of ceramic such as silicon nitride or alumina (preferably, with a thermal conductivity of 2 W/m·K or more, further preferably 3 W/m·K or more, particularly preferably 10 W/m·K or more, especially 20 W/m·K or more). As the thickness of the adhesive agent (herein, the thickness immediately after application) is smaller, the heat dissipating characteristic can be enhanced. For example, it can be 1 mm or less, or further 0.5 mm or less (the thickness of the adhesive agent after the coil 2 is joined may be further thinner). When the thermal conductivity is great, the thickness of the adhesive agent may be 1 mm or more. Using screen printing or sheet-like adhesive agent, a thin adhesive agent layer can be formed easily.

In manufacturing the coil component 20A, disposing an interval retaining member (not shown) for retaining the interval between the coil 2 and the inner core portion 31, it becomes easier to simplify the structure of the mold assembly. The interval retaining member may be, for example: a sleeve-like member (may be short, and such a sleeve-like shape may be formed by a combination of a plurality of divided pieces) disposed at the outer circumference of the inner core portion 31; an annular member having an L-shaped cross section and including the aforementioned sleeve-like member and one or more flat plate-like flange portions projecting outward from the periphery of the sleeve-like member; a plate member disposed between the coil 2 and the inner core portion 31; and a combination of the foregoing. Since the interval retaining member is integrated with the coil 2 and others by the resin forming the resin mold portion 21, when it is made of an insulating resin such as PPS resin, LCP, polytetrafluoroethylene (PTFE) resin described above, insulation between the coil 2 and the inner core portion 31 can be enhanced. When the sleeve-like member or the annular member described above is employed, the shape or thickness thereof is adjusted by partially reducing the thickness or providing cutting, such that the resin forming the resin mold portion 21 is fully packed between the coil 2 and the inner core portion 31.

(Magnetic Core)

A description of the magnetic core 3 will be given with reference to mainly FIGS. 1 and 2. As described above, the magnetic core 3 includes the columnar inner core portion 31 and the outer core portion 32 that is disposed at at least one of the end faces 31*e* of the inner core portion 31 (herein the opposite end faces) and on the outer circumferential side of the coil 2 to cover the outer circumferential face of the coil component 20A (mainly the outer circumferential face of the coil 2). The magnetic core 3 forms a closed magnetic path when the coil 2 is energized.

<Inner Core Portion>

Herein, since the inner core portion 31 is slightly longer than the length of the coil 2 in the axial direction, the opposite end faces 31*e* and nearby outer circumferential face of the inner core portion 31 are slightly project from the end faces of the coil 2 in the state where the inner core portion 31 is inserted and disposed in the coil 2. This state is maintained by the resin mold portion 21. The length of the inner core portion 31 projecting from each end face of the coil 2 (hereinafter referred to as the projection length) can be selected as appropriate. Herein, though each projection length is equal, it may be different. Alternatively, the length of the inner core portion or the disposition position of the inner core portion relative to the coil can be adjusted such that the projecting portion is present at only one of the end faces of the coil 2. When the length of the inner core portion is equal to or greater than the length of the coil, the magnetic flux formed by the coil 2 can be allowed to fully pass through the inner core portion 31.

Though the magnetic core 3 may be made of a uniform material in its entirety, herein, the material of the magnetic core 3 is partially different. The inner core portion 31 is formed by a powder magnetic core, whereas the outer core portion 32 is formed by a composite material.

The powder magnetic core is representatively manufactured by molding raw material powder under pressure, and thereafter performing thermal treatment as appropriate. Even when the powder magnetic core is in a complicated three-dimensional shape, it can be molded relatively easily. The raw material powder may include coated powder in which the surface of metal particles made of an iron base material (iron group metal or iron alloy) or a soft magnetic material such as rare-earth metal is provided with an insulating coat made of silicone resin or phosphate, ferrite powder, or mixed powder in which resin such as thermoplastic resin or an additive such as higher fatty acid (representatively, the additive that vanishes or changes into an insulating substance by thermal treatment) is mixed as appropriate. By the foregoing manufacturing method, a powder magnetic core in which an insulating substance is interposed among the soft magnetic particles can be obtained. Since the powder magnetic core exhibits excellent insulation, the eddy current loss can be reduced. Further, the powder magnetic core can increase the saturation magnetic flux density than the composite material forming the outer core portion 32 does, when the raw material or the manufacturing condition is adjusted by the soft magnetic powder of the raw material or the molding pressure being increased. As the powder magnetic core, a known powder magnetic core can be employed.

The columnar inner core portion 31 may be an integrated element that is molded using a mold assembly of a desired shape, or a lamination product in which a plurality of core pieces each made of the powder magnetic core are laminated. The lamination products can be fixed by an adhesive agent or an adhesive tape to be an integrated element. Herein, the inner core portion 31 is a solid element in which no gap member or air gap is interposed.

<Outer Core Portion>

Herein, the outer core portion 32 is in a shape conforming to the space formed by the inner circumferential face of the case 4A and the portion of the outer circumferential face of the coil component 20A, the portion being stored in the case 4A. The coil component 20A is covered by the outer core portion 32 except for the outer surface of the case 4A (the side face and the outer bottom face 40*o* of the bottom plate portion 40) and the opposite end portions of the wire 2*w*. Since part of the outer core portion 32 is provided so as to be coupled to the opposite end faces 31*e* of the inner core portion 31, the magnetic core 3 forms a closed magnetic path.

The composite material forming the outer core portion 32 can be representatively manufactured by injection molding, transfer molding, MIM (Metal Injection Molding), cast molding, press molding using magnetic substance powder and powdery solid resin, and the like. In the injection molding, a prescribed pressure is applied to a mixture containing magnetic substance powder and resin while the mixture is packed into a mold assembly, and thus the mixture is molded. Thereafter, the resin is cured, whereby the composite material is obtained. In the transfer molding and the MIM also, molding is performed by packing a raw material into a mold assembly. In the cast molding, the mixture is poured into a mold assembly or the case 4A without application of a pressure. Then, the mixture is molded and cured, whereby the composite material is obtained. Herein, since the case 4A including the container 43 in which the wall portion 41 and the lid portion 42 are integrally molded is used, the outer core portion 32 is structured by a plurality of composite materials as shown in FIG. 2. Specifically, part of the outer core portion 32 is mold products (divisional mold products 32*a* and 32*b*) separately molded using a mold assembly, and the other part is a mold product (integral mold product 32*c*) obtained by molding using the container 43 as a mold assembly. Then, the mold products 32*a* to 32*c* are combined, whereby the outer core portion 32 whose appearance is a rectangular parallelepiped-shape is formed.

When a mold assembly is used to separately form such composite materials, the time required for packing the raw material is short. Therefore, the composite materials can be produced in a large quantity, and hence excellent productivity is exhibited. Further, composite materials (the divisional mold products) of any shape can be easily molded. On the other hand, in the situation where the case (herein the container 43, which holds true throughout this paragraph) is used as a mold assembly and the raw material is directly packed to form a composite material, the case and the composite material can be closely brought into contact with each other with ease. In particular, when the inner face of the case used as a mold assembly is also subjected to surface roughening treatment described above similarly to the heat dissipating pedestal portions 401 and the like, the contact area between the case and the outer core portion 32 can be increased, whereby the heat dissipating characteristic can be enhanced. When the integral mold product 32*c* is molded using the container 43 as a mold assembly, cores are disposed for forming through holes at the integral mold product 32*c* such that the end portions of the wire 2*w* can be drawn outside the case 4A. After molding is performed, the cores are removed. The through holes are provided so as to be continuous to the wire holes 42*h* formed at the container 43. In packing the raw material in the container 43, cores closing or penetrating the wire holes 42*h* should be disposed.

As shown in FIG. 2, the mold products 32*a* to 32*c* are divided in the radial direction of the coil 2. Herein, joining faces 320 and 320*c* of the mold products 32*a* to 32*c* are formed by flat surfaces, such that the seam portion of the mold products 32*a* to 32*c* that is disposed on the end face side of the coil 2 becomes a straight line along the axial direction of the coil 2, and the seam portion that is disposed on the outer circumferential face of the coil 2 side is disposed in parallel to the axial direction of the coil 2. The dividing direction of the composite materials forming the outer core portion 32 can be selected as appropriate. As shown in this example, when the elements are divided such that the seam portion disposed on the outer circumferential face side of the coil 2 is disposed so as not to be perpendicular (preferably, so as to be in parallel) to the axial direction of the coil 2, the seam portion does not easily interrupt (preferably, substantially does not interrupt) the magnetic flux, and a reduction in the magnetic characteristic caused by the interrupted magnetic flux can be suppressed. Further, the number of dividing cuts and the shape of the divisional mold products and integral mold product can be selected as appropriate in the range in which the mold products can be stored in the case 4A. As the number of dividing cuts is smaller, the number of assembly steps can be reduced, and hence excellent productivity of the reactor is exhibited. When the mold products are each in a shape conforming to the object to be covered, the magnetic path can be further intensified.

The divisional mold products 32*a* and 32*b* are each a II-shaped member that is assembled to the region on the installation side in the coil 2 (the region on the bottom side in FIG. 2). Further, the divisional mold products 32*a* and 32*b* each have a coil covering face 321 that covers the coil 2, and a pedestal covering face 322 that covers the heat dissipating pedestal portion 401. The coil covering face 321 is formed by a curved surface that conforms to the outer circumferential face of the coil 2 in the coil component 20A. The pedestal covering face 322 is formed by flat surfaces that conform to the end faces and side face of the heat dissipating pedestal portion 401 in the coil component 20A. The integral mold product 32*c* is a member that has a II-shaped cross section and that covers the region where the wire 2*w* is drawn out in the coil component 20A (the coil 2) (the region on the top side in FIG. 2). In short, the integral mold product 32*c* is a rectangular parallelepiped, whose one face is concave so as to conform to the outer circumferential face of the coil 2. Before the coil component 20A and the divisional mold products 32*a* and 32*b* are assembled to each other, the integral mold product 32*c*, the concave inner side face (not shown) and a quadrangular frame-shaped joining face (not shown) are exposed. Further, the integral mold product 32*c* has through holes into which the end portions of the wire 2*w* are inserted. Further, similarly to the divisional mold products 32*a* and 32*b*, the integral mold product 32*c* can also be a mold product that is separately fabricated using a mold assembly, which is then stored in the case 4A (the container 43).

Herein, as described above, the portions of the mold products 32*a* to 32*c* that are brought into contact with the coil component 20A are shaped so as to conform to the outer shape of the coil component 20A. Therefore, the magnetic path can be fully secured. When the inner face shape of the composite material does not exactly conform to the shape of the coil component 20A, but it is in a simple shape roughly conforming to the shape (e.g., the inner space formed by a combination of a plurality of composite materials is in a rectangular parallelepiped-shape), excellent moldability of the composite material is achieved.

The magnetic substance powder in the composite material forming the outer core portion 32 may be of the same composition as the soft magnetic powder forming the inner core portion 31 described above, or may be of different composition. In the situation where they are identical in composition also, since the composite material contains resin being a non-magnetic material, it is lower in saturation magnetic flux density and in relative permeability than the powder magnetic core. Accordingly, forming the outer core portion 32 by the composite material, it becomes possible to set the outer core portion 32 to be lower in relative permeability than the inner core portion 31 made of the powder magnetic core. Further, since the inner core portion 31 is the powder magnetic core, the saturation magnetic flux density can be increased easily as compared to the composite material disposed around the outer circumference of the coil 2.

The magnetic substance powder in the composite material may be made of a single type of powder or a plurality of types of powder differing in material. The composite material forming the outer core portion 32 is preferably iron base powder such as pure iron powder. Further, when the composite material is coated powder similarly to the powder magnetic core, insulation among soft magnetic particles can be enhanced, whereby the eddy current loss can be reduced.

The average particle size of the magnetic substance powder in the composite material may be 1 μm or greater and 1000 μm or less, particularly 10 μm or more and 500 μm or less. Further, when the magnetic substance powder includes a plurality of types of powder differing in particle size (coarse powder and fine powder), a reactor with high saturation magnetic flux density and low loss can be easily obtained. Note that, the magnetic substance powder in the composite material is substantially identical to the powder of the raw material (maintained). Using the powder whose average particle size falls within the range noted above as the raw material, excellent flowability is exhibited. Thus, using injection molding or the like, composite materials such as the divisional mold products 32*a* and 32*b* can be manufactured highly productively.

The content of the magnetic substance powder in the composite material forming the outer core portion 32 may be 40 volume percent or more and 70 volume percent or less, when the composite material is 100 percent. Since the magnetic substance powder is 40 volume percent or more, the proportion of the magnetic component is fully high, whereby the magnetic characteristic such as the saturation magnetic flux density of the whole magnetic core 3 can be enhanced easier. When the magnetic substance powder is 70 volume percent or less, excellent manufacturability of composite materials such as the divisional mold products 32*a* and 32*b* is exhibited.

The resin serving as the binder in the composite material may be representatively thermosetting resin such as epoxy resin, phenolic resin, silicone resin, and urethane resin. Other example may include thermoplastic resin such as PPS resin, polyimide resin, fluororesin, and polyamide resin, room temperature curing resin, or low temperature curing resin.

It is also possible to employ a composite material containing, in addition to the magnetic substance powder and the resin, powder (filler) made of a non-magnetic substance such as ceramic, e.g., alumina or silica. The filler contributes toward improving the heat dissipating characteristic, and suppressing uneven distribution of the magnetic substance powder (uniform dispersion). Further, when the filler is in a form of fine particles, since the filler is interposed among the magnetic substance particles, a reduction in the proportion of the magnetic substance powder attributed to the contained filler can be suppressed. When the composite material is 100 mass percent, the content of the filler should be 0.2 mass percent or more and 20 mass percent or less, furthermore 0.3 mass percent or more and 15 mass percent or less, particularly 0.5 mass percent or more and 10 mass percent or less. Thus, the effects described above can be fully obtained.

Herein, the outer core portion 32 is formed by the composite material made up of coated powder, in which particles of iron base material (pure iron) whose average particle size is 75 μm or less are provided with an insulating coat on their surface, and epoxy resin (the content of pure iron powder in the composite material is 40 volume percent). Further, no gap member or air gap is interposed in the outer core portion 32 also. Accordingly, the magnetic core 3 is entirely free of gap. Since no gap is included, the following advantages are obtained: (1) a reduction in size; (2) a reduction in loss; and (3) suppression of a reduction in inductance when being energized with great current. Note that, in the magnetic core 3, gap members made of a non-magnetic material, e.g., alumina plates, or air gaps may be interposed.

The shape of the outer core portion 32 is not particularly limited so long as a closed magnetic path can be formed. As in the present embodiment, when substantially the entire circumference of the coil component 20A except for the outer surface of the bottom plate portion 40 is covered by the composite material, the composite material (the outer core portion 32) can strengthen the mechanical protection of the coil component 20A. Further, herein, since the outer core portion 32 can be brought into contact with not only the bottom plate portion 40 including the heat dissipating pedestal portions 401 but also with the wall portion 41 and the lid portion 42, the heat from the outer core portion 32 can be efficiently transferred to the outside of the case 4A via the entire case 4A.

<Magnetic Characteristic>

As described above, since the magnetic core 3 is made of different materials, the magnetic core 3 is partially different in the magnetic characteristic. Herein, the inner core portion 31 is higher in saturation magnetic flux density than the outer core portion 32, and the outer core portion 32 is lower in relative permeability than the inner core portion 31. Specifically, the inner core portion 31 made of the powder magnetic core has a saturation magnetic flux density of 1.6 T or more, and that is 1.2 times or more as great as the saturation magnetic flux density of the outer core portion 32. The relative permeability of the inner core portion 31 is 100 or more and 500 or less. The outer core portion 32 made of the composite material has a saturation magnetic flux density of 0.6 T or more, and that is less than the saturation magnetic flux density of the inner core portion 31. The relative permeability of the outer core portion 32 is 5 or more and 50 or less, preferably 10 or more and 30 or less. The relative permeability of the entire magnetic core 3 made up of the inner core portion 31 and the outer core portion 32 is 10 or more and 100 or less. In the mode in which the saturation magnetic flux density of the inner core portion is high, when it is intended to obtain the magnetic flux identical to that of the magnetic core as a whole having uniform saturation magnetic flux density, the cross-sectional area of the inner core portion can be reduced. Therefore, this mode contributes toward reducing the size of the reactor. In this mode, the saturation magnetic flux density of the inner core portion 31 is 1.8 T or more, and further preferably 2 T or more. It is preferable that the saturation magnetic flux density of the inner core portion 31 is 1.5 times, more preferably 1.8 or more, as great as the saturation magnetic flux density of the outer core portion 32. Using a lamination product of electromagnetic steel sheets represented by silicon steel plates in place of the powder magnetic core, the saturation magnetic flux density of the inner core portion can be increased further easier. On the other hand, when the relative permeability of the outer core portion 32 is set to be lower than that of the inner core portion 31, the magnetic saturation can be suppressed. Accordingly, for example, the magnetic core 3 of a gapless structure can be obtained. With the magnetic core 3 of a gapless structure, a leakage flux can be reduced.

(Case)

In the case 4A storing the assembled product of the coil 2 and the magnetic core 3, herein, the plate-like bottom plate portion 40 (FIG. 3) and the frame-like wall portion 41 provided to stand from the bottom plate portion 40 are each an independent member. The bottom plate portion 40 and the wall portion 41 are integrated with each other with any appropriate fixing member. Herein, the case 4A includes the container 43 in which the wall portion 41 and the lid portion 42 are integrally molded. Attaching the container 43 to the bottom plate portion 40, the entire circumference of the assembled product is covered by the case 4A.

In the bottom plate portion 40, the inner bottom face 40*i* serves as the face for placing the assembled product and the face for attaching the wall portion 41, while the outer bottom face 40*o* serves as the cooled face by at least partially (herein, entirely) being brought into contact with the installation target and cooled thereby. The outer bottom face 40*o* is allowed to partially include a region (a flat surface or a curved surface) that is not brought into contact with the installation target. Though FIG. 1 shows the mode in which the outer bottom face 40*o* is disposed on the bottom side, it may be disposed on the side (right or left in FIG. 1) or on the top side.

Herein, the wall portion 41 is quadrangular frame-shaped, conforming to the quadrangular plate-like bottom plate portion 40. One of the opening portions of the frame is closed by the bottom plate portion 40, while the quadrangular plate-like lid portion 42 is integrally molded with the other opening portion. Thus, the quadrangular box-like container 43 is structured. Since the container 43 in which the lid portion 42 is integrally molded is included, as described above, the container 43 can be used as a mold assembly for the composite material (used with the wire holes 42*h* being closed). Furthermore, the stored item in the case 4A can be prevented from coming off, and the stored item can be protected. In addition, employing a non-magnetic but conductive material as the constituent material of the container 43 as will be described later, an occurrence of leakage flux can be prevented. Employing a material with excellent thermal conductivity such as a metal material, an improvement in the heat dissipating characteristic can be expected.

The lid portion 42 is provided with the wire holes 42*h* into which the opposite end portions of the wire 2*w* are inserted. The wire holes 42*h* communicate with the through holes provided at the composite material (the integral mold product 32*c*).

Various fixing members, e.g., a fastening member such as an adhesive agent or bolts, can be used for integrally connecting the bottom plate portion 40 and the wall portion 41 (herein the container 43) to each other. Herein, the bottom plate portion 40 and the wall portion 41 are integrated using an adhesive agent.

In addition, the case 4A includes attaching portions for fixing the reactor 1A to the installation target. Herein, attaching portions 400 and 410 are provided to the bottom plate portion 40 and the wall portion 41, respectively. The attaching portions 400 and 410 have bolt holes (which may be threaded holes or through holes without threading) into which fixing-purpose bolts 100 are inserted. The attaching portions 400 and 410 are projecting pieces projecting from the corners of the quadrangle, each provided with the bolt hole at the center, such that the bolt holes of the portions 400 and 410 communicate with each other. Since the attaching portions 400 and 410 are included, the reactor 1A can be easily fixed to the installation target. The attaching position, the number of pieces and shape of the attaching portions 400 and 410 can be selected as appropriate. Further, though the portions 40 and 41 respectively include the attaching portions 400 and 410 herein, it is also possible that solely the bottom plate portion 40 includes the attaching portions 400, or solely the wall portion 41 includes the attaching portions 410. The attaching portions 400 and 410 may be dispensed with.

The shape and size of the case 4A can be selected as appropriate in accordance with the shape and size of the stored item.

In the case 4A, at least the bottom plate portion 40 is made of a non-magnetic metal material as described above. When the wall portion 41 and the lid portion 42 are also made of a non-magnetic metal material or a material whose thermal conductivity is higher than that of the magnetic substance powder forming the magnetic core 3, specifically the above-noted aluminum, magnesium, or alloy thereof, an excellent heat dissipating characteristic is obtained, and furthermore, a leakage flux to the outside the case can be prevented. With the present invention, since the bottom plate portion 40 and the wall portion 41 are each an independent member, they can be made of different constituent materials. For example, the wall portion 41 and the lid portion 42 that are substantially brought into contact with solely the outer core portion 32 may be made of a non-magnetic and non-conductive material, such as resin. The bottom plate portion 40, the wall portion 41 and the lid portion 42 may be made of different metal materials. For example, the constituent material made of the bottom plate portion 40 may be made of a metal material whose thermal conductivity is higher than that of the wall portion 41. Herein, the entire case 4A is made of an aluminum alloy.

As shown in this example, in the situation where the entire case 4A is made of a metal material, and a composite material being the outer core portion 32 is molded by cast molding using at least part of the case 4A as a mold assembly, it is preferable to perform any treatment for enhancing adhesion with the composite material because the heat dissipating characteristic can be improved. Specifically, minor concave and convex may be provided to at least part of the region in the case 4A used as a mold assembly (herein the inner face of the container 43), preferably by 50 area percent or more, and further preferably 80 area percent or more. For forming the minor concave and convex, the surface roughening treatment described above can be used.

(Uses)

The reactor 1A structured as described above can be suitably used where the energizing conditions are, for example: the maximum current (direct current) is about 100 A to 1000 A; the average voltage is about 100 V to 1000 V; and the working frequency is about 5 kHz to 100 kHz. Representatively, the reactor 1A can be suitably used as a constituent component of an in-vehicle power converter apparatus of an electric vehicle, a hybrid vehicle and the like.

(Size of Reactor)

When used as an in-vehicle component, the reactor 1A preferably has a capacity of about 0.2 liters (200 $cm^3$) to 0.8 liters (800 $cm^3$), including the case 4A. In the present embodiment, the capacity is about 540 $cm^3$.

(Method of Manufacturing Reactor)

The reactor 1A can be manufactured as follows, for example. Herein, firstly, the coil 2, the inner core portion 31, and the bottom plate portion 40 shown in FIG. 3 are separately prepared, which are then integrally molded by the resin mold portion 21 (FIG. 2), to obtain the coil component 20A (FIG. 2).

Next, the container 43 shown in FIG. 2 is prepared. Using the container 43 as a mold assembly, the integral mold product 32*c* forming part of the outer core portion 32 is manufactured by cast molding. Specifically, a mixture is fabricated from the magnetic substance powder and resin being the raw material of the outer core portion 32, and binder or a non-magnetic substance powder as appropriate. The mixture is packed into the container 43 serving as a mold assembly, and thereafter the resin is cured. A similar mixture is packed into any appropriate mold assembly and the resin is cured, to manufacture the divisional mold products 32*a* and 32*b* forming other part of the outer core portion 32.

The prepared divisional mold products 32*a* and 32*b* are assembled to the outer circumference of the coil component 20A, and the container 43 is disposed on the bottom plate portion 40 such that the container 43 covers the obtained combined product. At this time, the mold products made of the composite material, or the inner core portion 31 and the outer core portion 32, may be joined to each other by an adhesive agent. Further, adhesion between the divisional mold products 32*a* and 32*b* and the wall portion 41 of the case 4A can be enhanced by packing an adhesive agent or the like therebetween. In disposing the container 43, using the drawn out portions of the wire 2*w* of the coil component 20A or the wire holes 42*h* as the guide, the container 43 can be precisely disposed relative to the bottom plate portion 40. Further, the wall portion 41 of the container 43 and the bottom plate portion 40 can be connected to each other by any appropriate fixing member. From the foregoing procedure, the reactor 1A (FIG. 1) can be obtained.

(Effects)

In connection with the reactor 1A, since the coil 2 and the bottom plate portion 40 forming the case 4A are integrally retained by the resin mold portion 21, the disposition state of the coil 2 relative to the case 4A is stable. In particular, even in the horizontal storage mode as the reactor 1A, the coil 2 is stabilized. Therefore, the heat of the coil 2 fixed to the bottom plate portion 40 can be transferred efficiently to the installation target via the bottom plate portion 40. Accordingly, in connection with the reactor 1A, part of the magnetic core 3 (herein the outer core portion 32) is made of the composite material containing the magnetic substance powder and the resin. Despite the coil 2 being covered by this composite material, an excellent heat dissipating characteristic is obtained.

In particular, since the reactor 1A according to the first embodiment is in the horizontal disposition mode as described above, there are many regions in which the distance from the outer circumferential face of the coil 2 to the installation target is short. Further, in connection with the reactor 1A, the bottom plate portion 40 integrally includes the heat dissipating pedestal portions 401, and the heat dissipating pedestal portions 401 each include the supporting face 402 that conforms to the outer circumferential face of the coil 2. Therefore, the heat of the coil 2 can be easily transferred to the bottom plate portion 40. Thanks to these points also, the reactor 1A has an excellent heat dissipating characteristic.

Further, since the heat dissipating pedestal portions 401 are made of a non-magnetic material, it magnetically influences the coil 2 very little even when the heat dissipating pedestal portions 401 are disposed in close proximity to the coil 2. Further, the resin mold portion 21 made of an insulating resin can secure insulation between the coil 2 and the bottom plate portion 40 (the heat dissipating pedestal portions 401 and the like) which are made of mainly metal.

In addition, though the bottom plate portion 40 includes the heat dissipating pedestal portions 401, in the reactor 1A, the bottom plate portion 40 and the wall portion 41 are separate members. Therefore, the constituent elements of the case 4A can be molded with ease. Further, use of the container 43 in which the wall portion 41 and the lid portion 42 are integrated can eliminate the attaching work of the lid portion 42. Further, since the reactor 1A includes the coil component 20A as a constituent element, the coil 2 can be handled with ease and the number of assembled components is small. Hence, excellent assemblability also is exhibited. In particular, with the reactor 1A, since the coil component 20A integrally retains part of the magnetic core 3 (the inner core portion 31) also, further excellent assemblability is exhibited. Thanks to these points, the reactor 1A also exhibits excellent productivity.

Further, with the reactor 1A, use of the container 43 in which the wall portion 41 and the lid portion 42 are integrated can protect the coil 2 and the magnetic core 3 as a whole from the external environment (dust or corrosion) and provide mechanical protection.

In addition, since at least part of the magnetic core 3 (herein the outer core portion 32) is the composite material described above, the following effects are attained.

(1) The outer core portion 32 can be formed with ease even in a complicated shape, i.e., covering the coil component 20A in which the coil 2, the inner core portion 31, and the bottom plate portion 40 (the heat dissipating pedestal portions 401) are integrated.

(2) When cast molding is employed in which the container 43 is used as a mold assembly, the manufacturing steps can be reduced, whereby excellent productivity is exhibited.

(3) The magnetic characteristic of the outer core portion 32 can be changed easily.

(4) Since the material covering the outer circumference of the coil component 20A (the coil 2) contains the magnetic substance powder, as compared to the situation where the material is solely resin, the thermal conductivity is higher and an excellent heat dissipating characteristic is obtained.

[Second Embodiment]

Figure 4:
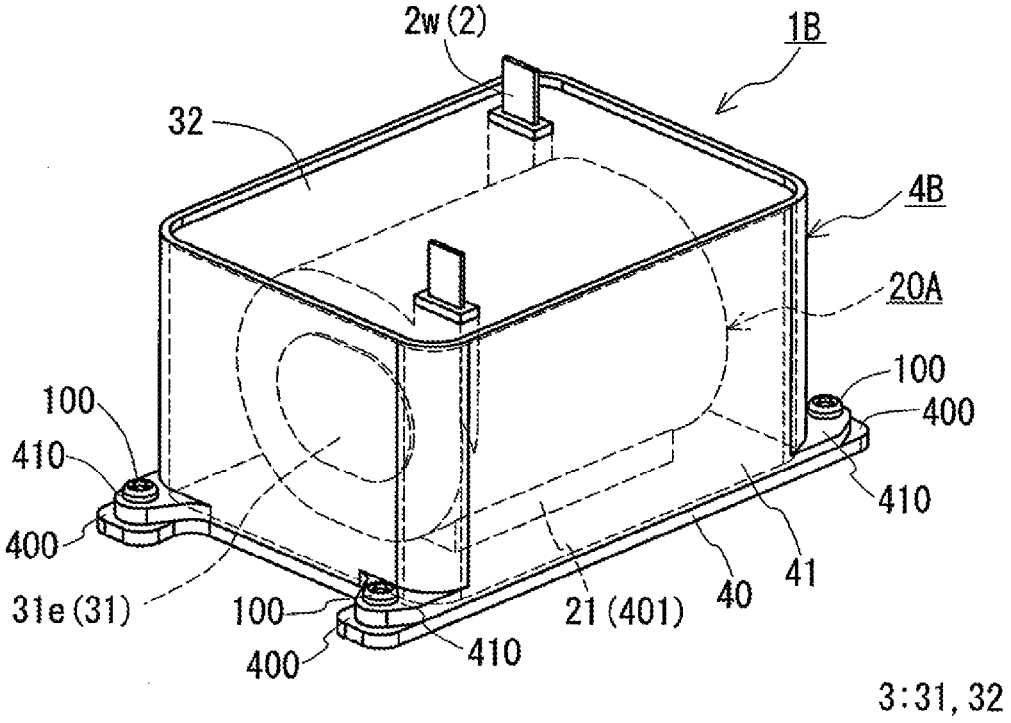
FIG. 4 is a schematic perspective view of the reactor according to a second embodiment.

With reference to FIG. 4, a description will be given of a reactor 1B according to a second embodiment. The basic structure of the reactor 1B according to the second embodiment is similar to that of the reactor 1A according to the first embodiment. A coil component 20A is included, in which a coil 2 mainly structured by one sleeve-like coil element, an inner core portion 31, and a bottom plate portion 40 including heat dissipating pedestal portions 401 are integrally retained by a resin mold portion 21. Further, in the reactor 1B, the outer circumferential side of the coil component 20A (the coil 2) is covered by an outer core portion 32 made of a composite material containing magnetic substance powder and resin, and further surrounded by a case 4B. The case 4B is formed by separate members, i.e., the bottom plate portion 40 and a wall portion 41, which are integrally connected to each other by any appropriate fixing member. The main differences of the reactor 1B according to the second embodiment from the first embodiment lies in that the case 4B does not have a lid portion, and is bottomed sleeve-like with an opening. In the following, a description will be given focusing on the difference, and the structures and effects similar to those of the first embodiment will not be described.

The wall portion 41 of the case 4B is quadrangular frame-shaped, and the one of the opening portions of the frame is closed by the bottom plate portion 40 similarly to the first embodiment, while the other opening portion remains open. Accordingly, as shown in FIG. 4, with the reactor 1B, one face of the outer core portion 32 covering the coil component 20A is exposed.

In the second embodiment, since the opening portion is present in the state where the case 4B is assembled, the entire outer core portion 32 can be formed by cast molding using the case 4B as a mold assembly. Specifically, as has been described in the section of the first embodiment, the coil component 20A is prepared. Then, the wall portion 41 is disposed on the bottom plate portion 40 so as to surround the outer circumference of the coil 2, and the bottom plate portion 40 and the wall portion 41 are joined to each other. In particular, in this mode, in the situation where the bottom plate portion 40 and the wall portion 41 are integrated by an adhesive agent, the mixture being the raw material of the outer core portion 32 can be prevented from leaking from the clearance between the portions 40 and 41. When fastening members such as bolts are used, a seal member (not shown) can be disposed between the portions 40 and 41. When the mixture cannot leak (e.g., when the viscosity of the mixture is high), the seal member can be dispensed with. Into the assembled case 4B, the mixture being the raw material of the outer core portion 32 is packed, and the resin is cured. From the foregoing procedure, the outer core portion 32 can be formed and the magnetic core 3 can be obtained. Furthermore, the reactor 1B can be obtained.

On the other hand, when the outer core portion 32 is to be a composite material (mold product) separately fabricated, as in the first embodiment, a plurality of divisional pieces divided in the radial direction of the coil 2 are molded, and the divisional pieces removed from the mold assembly is assembled to the coil component 20A. Thereafter, the wall portion 41 should be attached to the bottom plate portion 40. When at least part of the outer core portion 32 is to be a mold product made of the composite material, a sealing resin may be packed in the case 4B. In this mode, the sealing resin can be easily packed when the case that is open similarly to the case 4B is used. The sealing resin can fix the mold products each made of the composite material to each other, or the mold products and the coil component to each other. The sealing resin may be an insulating resin such as epoxy resin, urethane resin, silicone resin and the like. When the resin containing a filler with excellent insulation performance or heat dissipating characteristic is used as the sealing resin, insulation between the coil or the magnetic core and the case as well as the heat dissipating characteristic can be improved. Depending on the material of the sealing resin or the thickness thereof, vibrations or noises can be advantageously provided.

In connection with the reactor 1B according to the second embodiment, in the situation where the composite material is formed by directly packing the raw material into the case 4B using the case 4B as a mold assembly, the following advantages are obtained: (1) the aforementioned assembly step or joining step of the magnetic core 3 (the step of joining the inner core portion 31 and the outer core portion 32 to each other by an adhesive agent) can be eliminated, and furthermore, in this situation, the reactor 1B can be obtained simultaneously with the formation of the outer core portion 32; (2) the outer core portion 32 can be molded with ease even when the coil component 20A has a complicated shape; and (3) the case 4B and the composite material can be easily closely brought into contact with each other. Particularly, when the surface roughening treatment is performed also to the case 4B (the inner bottom face and the inner face of the wall portion) similarly to the heat dissipating pedestal portions 401, the contact area between the case 4B and the outer core portion 32 can be increased, whereby the heat dissipating characteristic can be enhanced.

Further, though the reactor 1B according to the second embodiment does not include a lid portion, the constituent material of the outer core portion 32 contains resin. Accordingly, protection from the external environment and mechanical protection of the coil component 20A can be achieved. Further, when a lid portion is not included, employing the mode in which part of the coil component 20A, particularly the region disposed on the opening side of the case 4B, is exposed outside the composite material, the heat dissipating characteristic is expected to be enhanced.

Note that, the reactor 1B according to the second embodiment also may include a quadrangular plate-like lid portion that covers the opening portion of the case 4B. When the lid portion is included, for example, a lid pedestal with which a fastening member such as a bolt fixing the lid portion is screwed is integrally provided at the wall portion of the case. The lid portion may include a projecting piece provided with a bolt hole into which a fastening member such as a bolt is inserted. The formation place and the number of lid pedestal and the projecting piece can be selected as appropriate.

[Third Embodiment]

Figure 5:
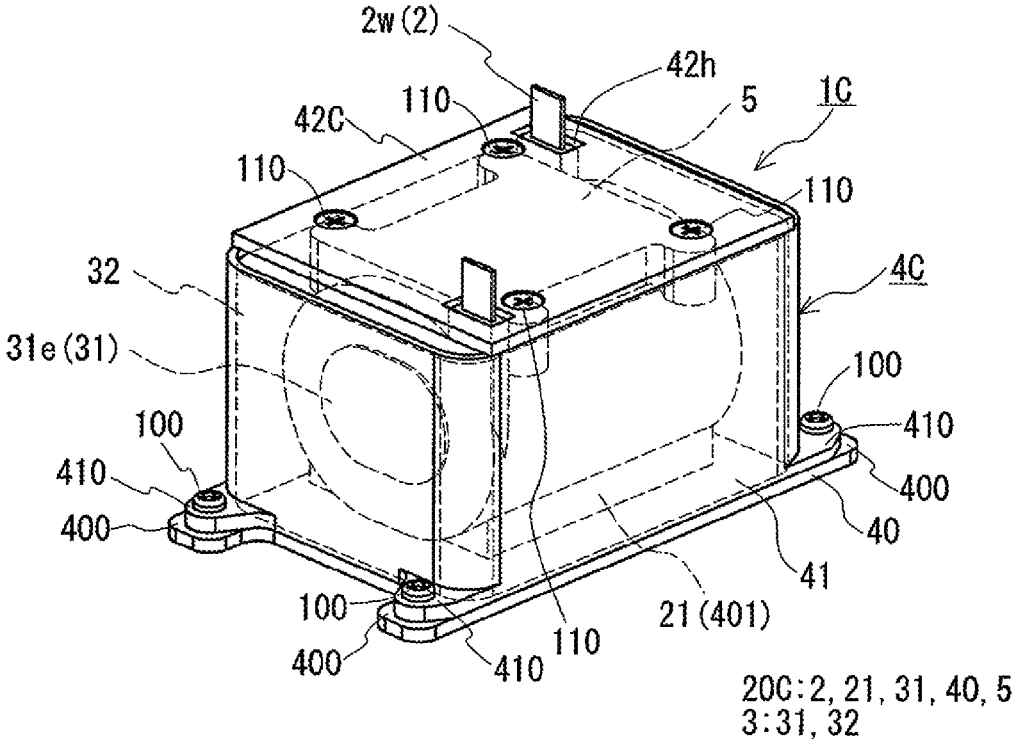
FIG. 5 is a schematic perspective view of the reactor according to a third embodiment.
Figure 6:
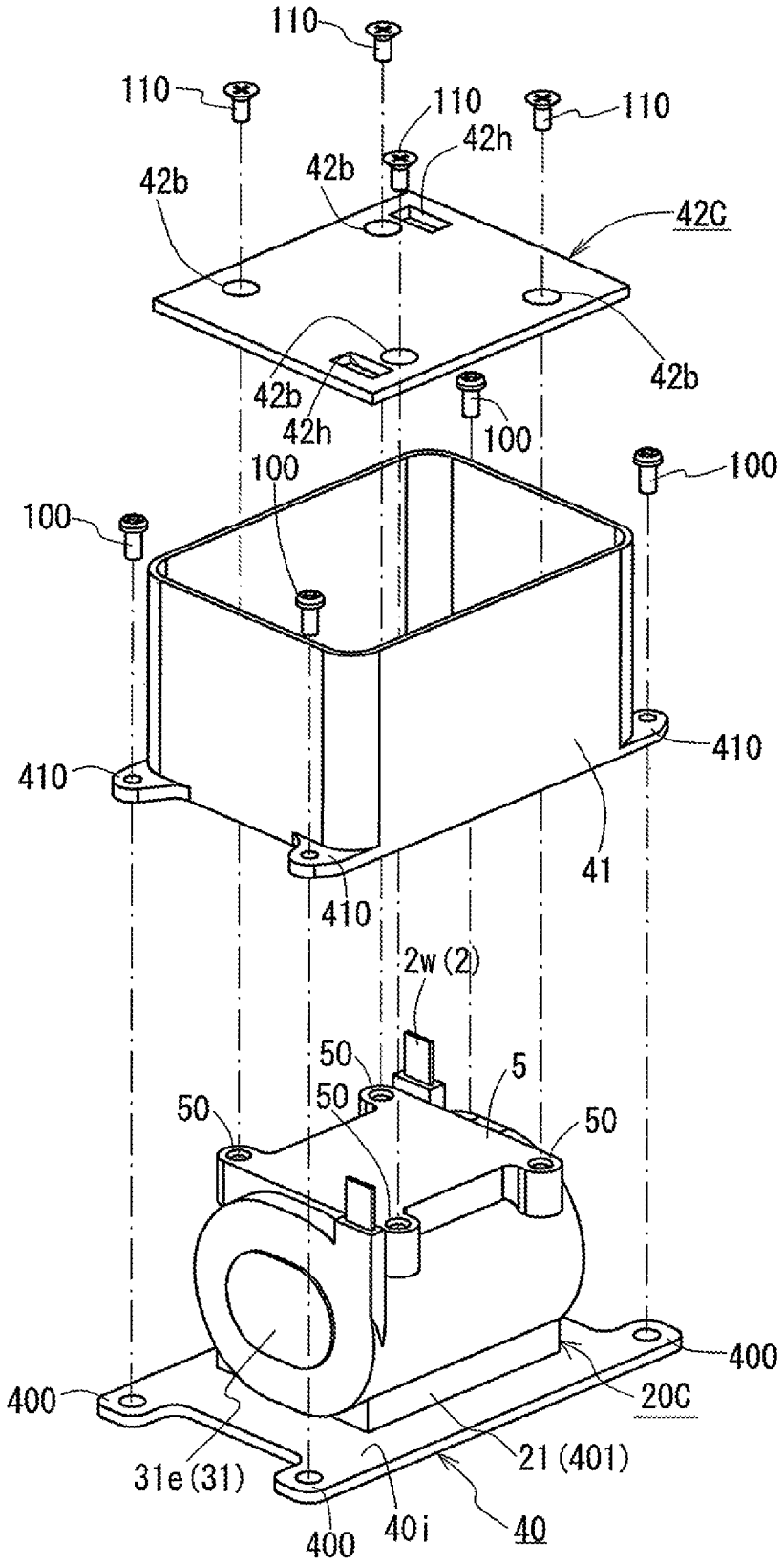
FIG. 6 is an exploded perspective view of the reactor according to the third embodiment.

With reference to FIGS. 5 and 6, a description will be given of a reactor 1C according to a third embodiment. The basic structure of the reactor 1C according to the third embodiment is similar to the reactor 1B according to the second embodiment. A coil component 20C is included, in which a coil 2 mainly structured by one sleeve-like coil element, an inner core portion 31, and a bottom plate portion 40 including heat dissipating pedestal portions 401 are integrally retained by a resin mold portion 21. Further, in the reactor 1C, the outer circumferential side of the coil component 20C (the coil 2) is covered by an outer core portion 32 made of a composite material containing magnetic substance powder and resin. The coil component 20C is stored in a bottomed sleeve-like case 4C in which the bottom plate portion 40 and a wall portion 41 are integrated by any appropriate fixing member. The main difference of the reactor 1C according to the third embodiment from the second embodiment lies in that the coil component 20C includes, in addition to heat dissipating pedestal portions 401, a lid-side pedestal portion 5, and a lid portion 42C attached to the lid-side pedestal portion 5. In the following, a description will be given focusing on the difference, and the structures and effects similar to those of the second embodiment will not be described. Note that, the outer core portion is not shown in FIG. 6.

The lid-side pedestal portion 5 is made of a non-magnetic metal material similarly to the heat dissipating pedestal portions 401 (the bottom plate portion 40) and the like. The lid-side pedestal portion 5 is disposed on the opening side of the case 4C (the top side in FIG. 5) at the outer circumferential face of the coil 2, and used as a heat dissipation path. The lid-side pedestal portion 5 is, as shown in FIG. 6, a quadrangular plate-like member, and the length in the axial direction of the coil 2 of the lid-side pedestal portion 5 is substantially identical to the length of the coil 2 in the axial direction. The lid-side pedestal portion 5 is disposed along the entire length of the coil 2 conforming to the outer circumferential face of the coil 2. The face of the lid-side pedestal portion 5 opposing to the outer circumferential face of the coil 2 is in a shape conforming to the outer circumferential face similarly to the inner bottom face 40*i* and the heat dissipating pedestal portions 401 of the bottom plate portion 40, and formed by curved surfaces and a flat surface similarly to the outer circumferential face of the coil 2 in a racetrack shape, with the area great enough to cover the region on the opening side of the case 4C. The face opposite to the above-described face (the top face in FIG. 6) is formed by a flat surface, and is in contact with an inner face of the lid portion 42C formed by a flat surface (FIG. 5).

End faces of the lid-side pedestal portion 5 are each ]-shaped, the thickness of which is small at the center portion and increases toward the opposite edge sides. The side faces are each formed by a rectangular flat surface. The corner portions of the lid-side pedestal portion 5 have fixing holes 50 with which fastening members such as bolts 110 for fixing the lid portion 42C are screwed. As shown in FIG. 6, formation portions of the fixing holes 50 project from the side faces. So long as the lid portion 42C can be fixed, the number of the fixing holes 50 or the disposition position can be selected as appropriate.

The lid-side pedestal portion 5 is disposed to oppose to the heat dissipating pedestal portions 401 provided at the bottom plate portion 40, with reference to the axis of the coil 2. The lid-side pedestal portion 5 is integrally retained with the coil 2 by the resin mold portion 21. Accordingly, in the coil component 20C included in the reactor 1C, the coil 2, the bottom plate portion 40 including the heat dissipating pedestal portions 401, the lid-side pedestal portion 5, and the inner core portion 31 are integrated by the resin mold portion 21. Further, the coil component 20C is exposed outside the resin mold portion 21 except for the face in the lid-side pedestal portion 5 brought into contact with the lid portion 42C, the areas in the inner bottom face 40*i* where the heat dissipating pedestal portions 401 are formed and the disposition area of the coil 2. Then, the lid portion 42C is attached by the bolts 110 so as to be brought into contact with the face of the lid-side pedestal portion 5 exposed outside the resin mold portion 21.

Since the resin forming the resin mold portion 21 is interposed between the coil 2 and the lid-side pedestal portion 5, insulation between the coil 2 and the lid-side pedestal portion 5 can be enhanced. Further, in order to increase the contact area between the lid-side pedestal portion 5 and the resin, surface roughening treatment can be performed also to the lid-side pedestal portion 5 (the face on the coil 2 side), similarly to the heat dissipating pedestal portions 401.

Similarly to the lid portion 42 included in the reactor 1A according to the first embodiment, the lid portion 42C includes wire holes 42*h* into which end portions of the wire 2*w* are inserted. Further, the lid portion 42C includes bolt holes 42*b* into which the bolts 110 are inserted. Since the lid portion 42C includes the bolt holes 42*b*, the projecting pieces with the bolt holes are not required. Thus, the lid portion 42C is in a simple shape. Further, with the reactor 1C, as described above, since the lid portion 42C is attached to the lid-side pedestal portion 5, the case 4C does not require the lid pedestal. Thus, the case 4C also is in a simple shape.

The reactor 1C according to the third embodiment includes, in addition to the heat dissipating pedestal portions 401 integrated with the bottom plate portion 40, the lid-side pedestal portion 5 made of a material with excellent thermal conductivity. Further, the lid portion 42C is fixed to the lid-side pedestal portion 5. Thus, the lid-side pedestal portion 5 and the lid portion 42C can be used as the heat dissipation path also, and the heat of the coil 2 can be efficiently transferred to the outside of the case 4C. Accordingly, the reactor 1C can enhance the heat dissipating characteristic on the opening side region of the case 4C, and a further excellent heat dissipating characteristic is obtained. Further, in reactor 1C, since the coil component 20C that integrally retains also the lid-side pedestal portion 5 with the coil 2 by the resin mold portion 21 is included as a constituent element, an increase in the number of the assembled components is not invited, and excellent assemblability is exhibited.

Note that, the lid-side pedestal portion may not include the fixing holes. For example, in connection with the lid-side pedestal portion, when the lid portion is fixed by an adhesive agent, the number of components can be reduced, and furthermore, the lid-side pedestal portion and the lid portion can be closely brought into contact with each other. Alternatively, the lid-side pedestal portion and the lid portion can be closely brought into contact with each other by application of grease between each other.

Alternatively, an engagement portion may be provided to each of the lid-side pedestal portion and the lid portion. For example, the lid portion may include a projection, and the lid-side pedestal portion may include a through hole or a concave portion into which the projection is fitted, or the lid portion may include a concave portion, and the lid-side pedestal portion may include a projection that is fitted into the concave portion. Alternatively, the foregoing manners may be practiced in combination. Further, the adhesive agent described above may be used in combination.

[Fourth Embodiment]

In the sections of the first to third embodiments, the description has been given of the mode in which the inner core portion 31 is made of the powder magnetic core and the outer core portion 32 solely is made of the composite material. It is also possible to employ the mode in which the inner core portion is also made of the composite material containing magnetic substance powder and resin, i.e., the mode in which the entire magnetic core is made of the composite material. In this situation, for example, the inner core portion and the outer core portion may be made of an identical composite material. In this situation, the content of the magnetic substance powder of the composite material forming the core portions may be 40 volume percent or more and 70 volume percent or less; the saturation magnetic flux density may be 0.6 T or more; the relative permeability may be 5 or more and 50 or less, preferably 10 or more and 30 or less; and the relative permeability of the entire magnetic core may be 5 or more and 50 or less. Further, in this situation, as described in the section of the second embodiment, the inner core portion and the outer core portion may be integrally molded using the case as a mold assembly, or they may each be a mold product made of the composite material.

Alternatively, the inner core portion and the outer core portion may be made of different composite materials. With this structure, for example, when the same magnetic substance powder is used, the saturation magnetic flux density or the relative permeability can be adjusted just by changing the content of the magnetic substance powder. Thus, it is advantageous also in that the composite material of any desired characteristic can be easily manufactured. In a specific mode, the inner core portion and the outer core portion are respectively formed by composite materials differing in the material or content of the magnetic substance powder, and the saturation magnetic flux density of the inner core portion is high while and the relative permeability of the outer core portion is low as in the first to third embodiments, or conversely, the relative permeability of the inner core portion is low and the saturation magnetic flux density of the outer core portion is high. Increasing the blending amount of the magnetic substance powder, the composite material with high saturation magnetic flux density and high relative permeability can be obtained easily. On the other hand, reducing the blending amount, the composite material with low saturation magnetic flux density and low relative permeability can be obtained easily. It is also possible to separately prepare columnar composite materials (mold products) by the raw material of the desired composition in advance, and the columnar composite materials can be used as the inner core portion and the outer core portion. The composite material forming each of the inner core portion and the outer core portion may have the following properties: the content of the magnetic substance powder is 40 volume percent or more and 70 volume percent or less; the saturation magnetic flux density is 0.6 T or more; the relative permeability is 5 or more and 50 or less; and preferably 10 or more and 30 or less. The relative permeability of the magnetic core as a whole may be 5 or more and 50 or less.

[Fifth Embodiment]

Figure 7:
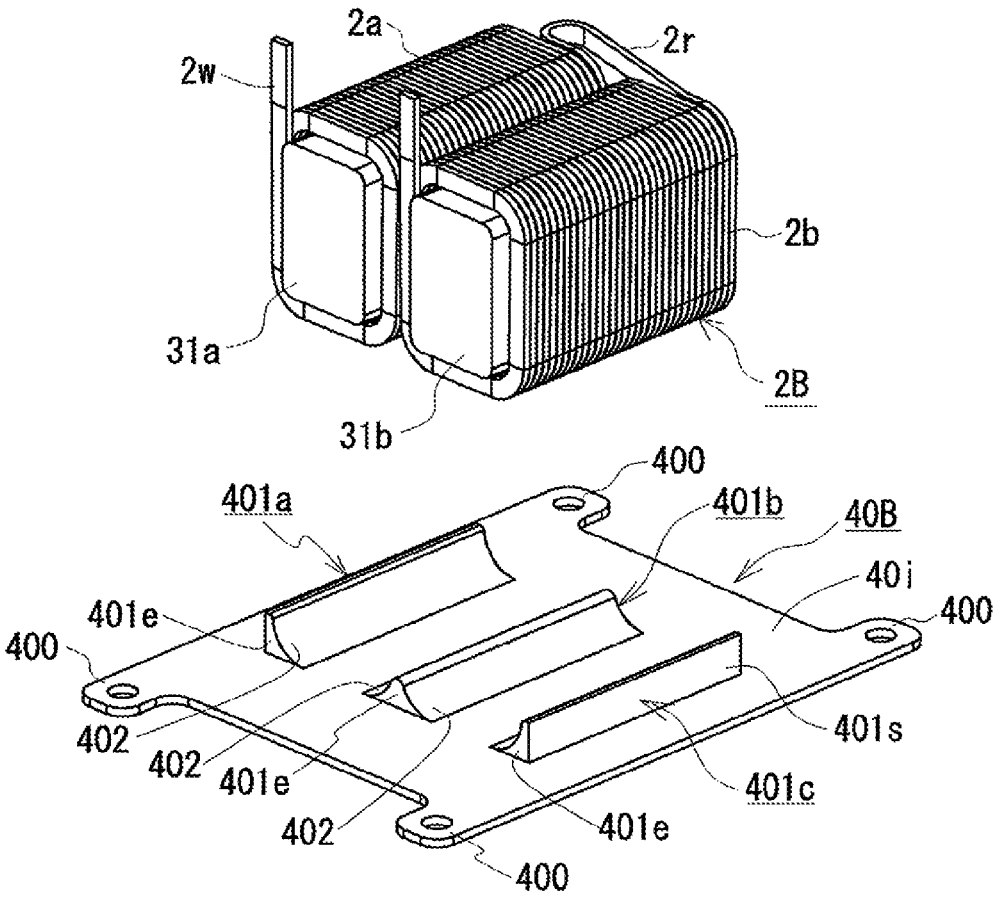
FIG. 7 is a schematic perspective view showing a coil, inner core portions, and a bottom plate portion included in a reactor according to a fifth embodiment.

In the sections of the first to fourth embodiments, the description has been given of the mode in which one coil element is included. In other possible mode, as coils 2B and 2C shown in FIGS. 7 and 8, a pair of coil elements 2*a* and 2*b* made of a spirally wound wire 2*w* may be included. The main difference between the coils 2B and 2C lies in the end face shape. The end face shape of the coil elements 2*a* and 2*b* of the coil 2B shown in FIG. 7 is quadrangular whose corner portions are rounded. The end face shape of the coil elements 2*a* and 2*b* of the coil 2C shown in FIG. 8 is a racetrack shape, as in the first embodiment.

Figure 8:
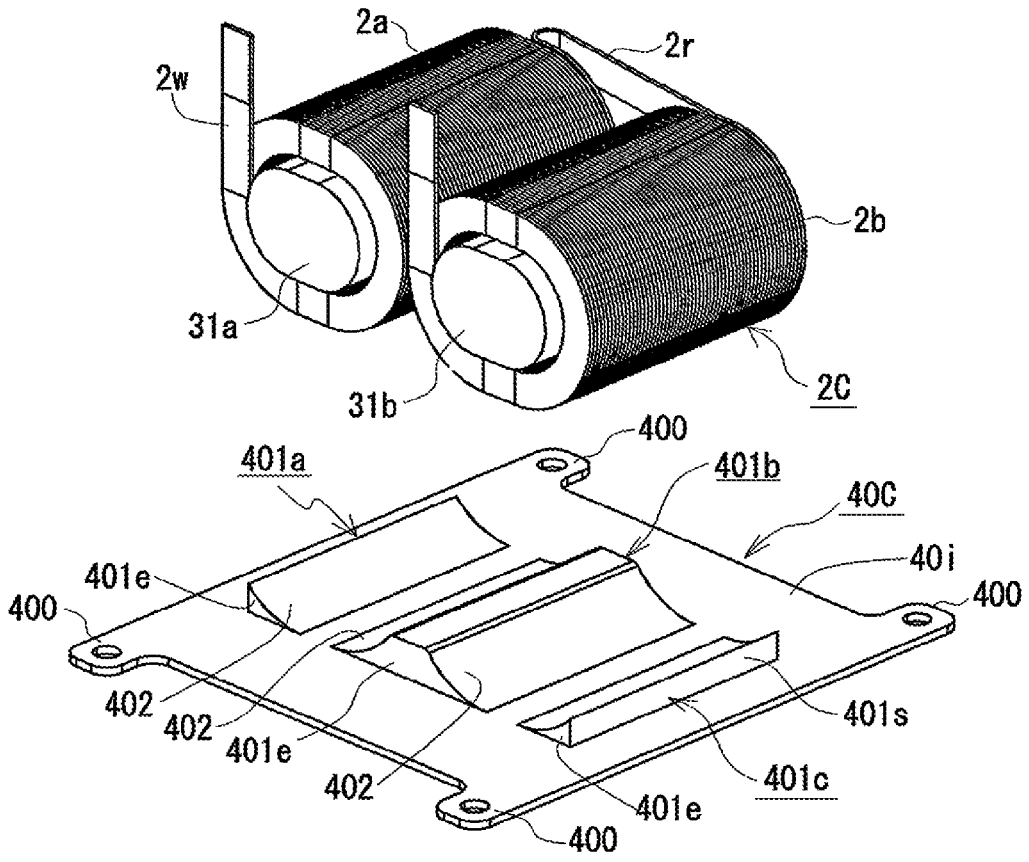
FIG. 8 is a schematic perspective view showing the coil, the inner core portions, and the bottom plate portion included in the reactor according to the fifth embodiment, with different end face shape of the coil.

A pair of coil elements 2*a* and 2*b* included in each of the coils 2B and 2C respectively shown in FIGS. 7 and 8 is juxtaposed (paralleled) such that the axes of the coil elements 2*a* and 2*b* are parallel to each other. The coil elements 2*a* and 2*b* are coupled to each other by a couple portion 2*r* formed by a portion of the wire 2*w* being folded back. It is also possible to employ the mode in which the coil elements 2*a* and 2*b* are made from separate wires, and the one end portions of the wires respectively forming the coil elements 2*a* and 2*b* are joined by welding such as TIG welding, fixation under pressure, soldering and the like. In other possible mode, the one end portions are joined to each other via a separately prepared coupling member. Then, for example, in the horizontal storage mode, what is formed is a coil component in which the coil 2B or 2C and bottom plate portion 40B or 40C are integrated by the resin mold portion (not shown), in the state where the installation side face of each of the juxtaposed coil elements 2*a* and 2*b* is disposed on the bottom plate portion 40B or 40C. The bottom plate portions 40B and 40C each have heat dissipating pedestal portions 401*a*, 401*b*, and 401*c* including supporting faces 402 conforming to the outer circumferential face of the coil elements 2*a* and 2*b*. Portions of the outer circumferential face of the coil elements 2*a* and 2*b* (the flat surface portions) are respectively disposed in parallel to portions of the inner bottom face 40*i* (the region between the heat dissipating pedestal portions 401*a* and 401*b* and the region between the heat dissipating pedestal portions 401*b* and 401*c*). Herein, though the mode in which a pair of coil elements 2*a* and 2*b* shares the heat dissipating pedestal portion 401*b* (three heat dissipating pedestal portions in total) is shown, the heat dissipating pedestal portions supporting the coil element 2*a* may be included by two in number and the heat dissipating pedestal portions supporting the coil element 2*b* may be included by two in number, i.e., the four heat dissipating pedestal portions in total may be included. In the situation where a pair of coil elements 2*a* and 2*b* is included, employing the horizontal storage mode, an excellent heat dissipating characteristic is exhibited. Furthermore, the coil component and the like can be manufactured with ease, without being hindered by the couple portion 2*r*.

In the situation where the two coil elements 2*a* and 2*b* are included also, it is possible to employ the mode in which the inner core portion is formed by the powder magnetic core and the outer core portion is formed by the composite material, as in the first embodiment. In this situation, as shown in FIGS. 7 and 8, a pair of inner core portions 31*a* and 31*b* respectively inserted and disposed into the coil elements 2*a* and 2*b* is prepared. The outer core portion can be easily disposed when it is in the mode in which the mold product integrated with the case (the container) and a plurality of divisional pieces are assembled to each other, as in the first embodiment. Alternatively, the outer core portion can be easily formed even into a complicated shape, when it is molded using the case as a mold assembly as in the second embodiment. In other possible mode, in the situation where the two coil elements 2*a* and 2*b* are included also, a lid-side pedestal portion may be included as in the third embodiment. Similarly to the lid-side pedestal portion 5 shown in FIGS. 5 and 6, when the lid-side pedestal portion has a supporting face conforming to the outer circumferential face of the coil elements 2*a* and 2*b*, a reactor exhibiting a further excellent heat dissipating characteristic can be structured.

[Sixth Embodiment]

In the situation where the two coil elements 2*a* and 2*b* are included also, as in the fourth embodiment, the magnetic core may be wholly made of the composite material. In this situation, the inner core portions respectively disposed in the coil elements 2*a* and 2*b* and the outer core portion disposed outside the coil elements 2*a* and 2*b* may each be a mold product made of the composite material, and such a plurality of mold products may be assembled. Alternatively, the inner core portions may be mold products while the outer core portion may be molded using the case as a mold assembly, as described above. Further, the inner core portions and the outer core portion may be made of the same composite material. The content of the magnetic substance powder of the composite material is 40 volume percent or more and 70 volume percent or less; the saturation magnetic flux density may be 0.6 T or more; and the relative permeability may be 5 or more and 50 or less, preferably 10 or more and 30 or less. The relative permeability of the magnetic core as a whole may be 5 or more and 50 or less. In this situation, when both the inner core portions and the outer core portion are integrally molded using the case as a mold assembly, the assembling work can be omitted.

Alternatively, the inner core portions and the outer core portion may be made of different composite materials. With this structure, for example, when the same magnetic substance powder is used, the saturation magnetic flux density or the relative permeability can be adjusted just by changing the content of the magnetic substance powder. Thus, it is advantageous also in that the composite material of any desired characteristic can be easily manufactured. Adjusting the material or content of the magnetic substance powder, for example, the mode in which the saturation magnetic flux density of the inner core portions is high and the relative permeability of the outer core portion is low, or the mode in which the relative permeability of the inner core portions is low and the saturation magnetic flux density of the outer core portion is high can be achieved. The composite material forming each of the inner core portions and the outer core portion may have the following properties: the content of the magnetic substance powder is 40 volume percent or more and 70 volume percent or less; the saturation magnetic flux density is 0.6 T or more; the relative permeability is 5 or more and 50 or less, preferably 10 or more and 30 or less. The relative permeability of the magnetic core as a whole may be 5 or more and 50 or less. In this situation, excellent manufacturability is exhibited when the inner core portions and the outer core portion are each a mold product made of the composite material.

[Variation 1]

In the section of the first embodiment, though the description has been given of the horizontal storage mode, the vertical disposition mode can be employed in each of the first to sixth embodiments. With the vertical disposition mode, the contact area relative to the installation target can be reduced easier, and a reduction in size of the installation area can be achieved.

With the vertical disposition mode, for example, the magnetic core is formed as follows. One end face of the inner core portion projects from one end face of the coil to be brought into contact with the inner bottom face of the case. The outer circumferential face on one end face side of the inner core portion projecting from the coil and other end face of the inner core portion are in contact with the composite material forming the outer core portion. To the bottom plate portion forming the case, for example, a rod-shaped, plate-like, or L-shaped heat dissipating pedestal portion is formed. Then, the state where this heat dissipating pedestal portion is disposed on one end face side of the coil is maintained by the resin mold portion, to provide the coil component. In this situation, the shape and number of pieces of the heat dissipating pedestal portion and the shape of the resin mold portion are selected such that the magnetic flux can fully pass between the inner core portion and the outer core portion. Further, in this situation, when the case is firstly assembled, and then the outer core portion is manufactured by cast molding using the case as a mold assembly, the outer core portion can be manufactured with ease.

[Variation 2]

In the section of the first embodiment, the description has been given of the coil component in which the inner core portion 31 also is integrated. On the other hand, the first to sixth embodiments may each employ the mode in which the coil component has no inner core portion 31, 31*a*, or 31*b*. That is, the coil and the bottom plate portion may be retained by the resin mold portion, and the coil component may have a hollow hole into which the inner core portion 31, 31*a*, or 31*b* is inserted and disposed. In manufacturing the coil component, the core may be used in place of the inner core portion 31 described above. Further, forming the hollow hole by adjusting the thickness of the resin provided inside the coil 2 (the coil element), the resin can be used for positioning the inner core portion 31, 31*a*, or 31*b*.

[Seventh Embodiment]

The reactor according to any of the first to sixth embodiments and Variations 1 and 2 may be used, for example, as a constituent component of a converter mounted on a vehicle or the like, or as a constituent component of a power converter apparatus including the converter.

Figure 9:
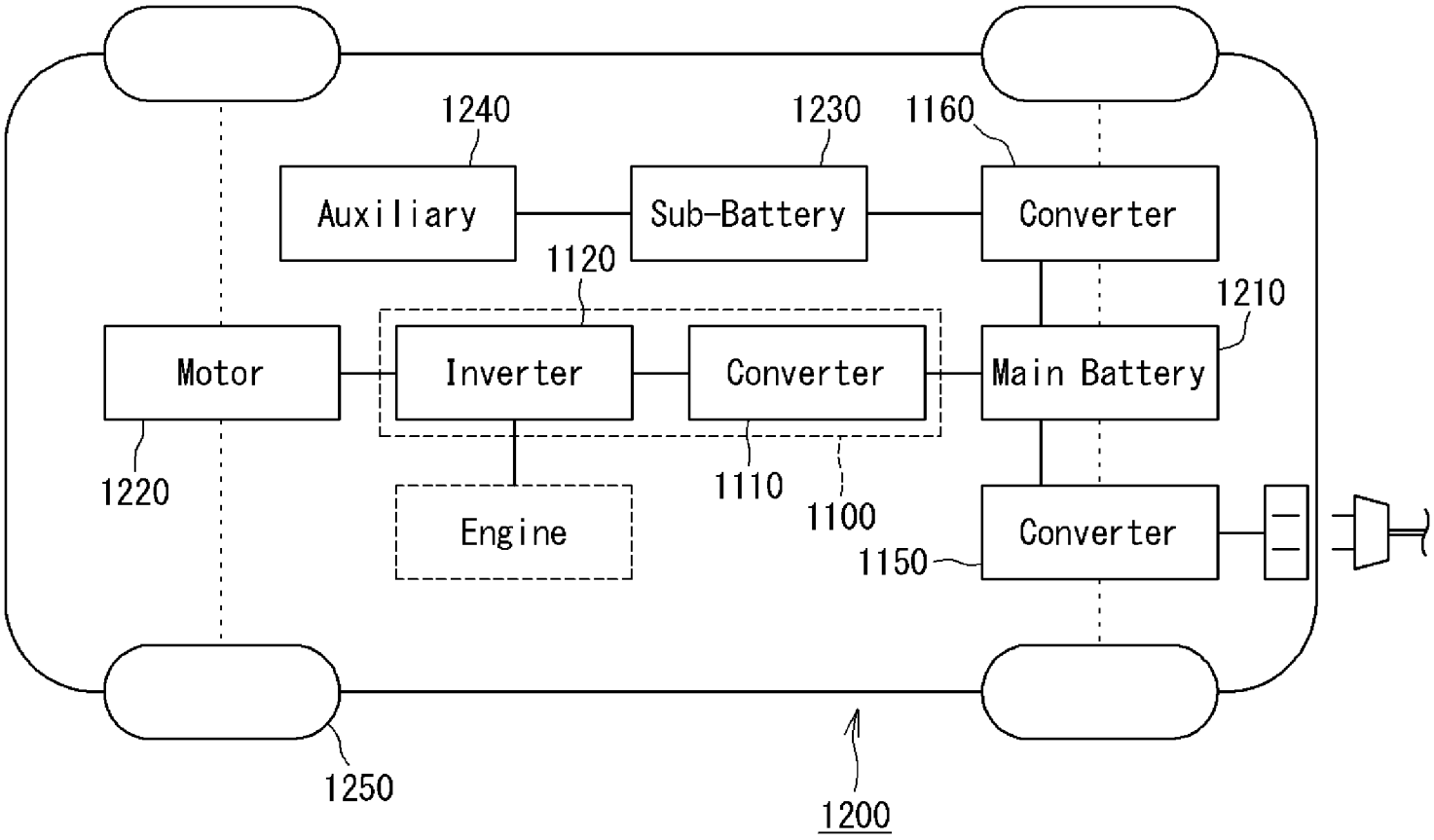
FIG. 9 is a schematic configuration diagram schematically showing a power supply system of a hybrid vehicle.

For example, as shown in FIG. 9, a vehicle 1200 such as a hybrid vehicle or an electric vehicle includes a main battery 1210, a power converter apparatus 1100 connected to the main battery 1210, and a motor (load) 1220 driven by power supplied from the main battery 1210 and serves for traveling. The motor 1220 is representatively a three-phase alternating current motor. The motor 1220 drives wheels 1250 in the traveling mode and functions as a generator in the regenerative mode. When the vehicle is a hybrid vehicle, the vehicle 1200 includes an engine in addition to the motor 1220. Though an inlet is shown as a charging portion of the vehicle 1200 in FIG. 9, a plug may be included.

The power converter apparatus 1100 includes a converter 1110 connected to the main battery 1210 to convert an input voltage, and an inverter 1120 connected to the converter 1110 to perform interconversion between direct current and alternating current. When the vehicle 1200 is in the traveling mode, the converter 1110 in this example steps up DC voltage (input voltage) of approximately 200 V to 300 V of the main battery 1210 to approximately 400 V to 700 V, and supplies the inverter 1120 with the stepped up power. Further, in the regenerative mode, the converter 1110 steps down DC voltage (input voltage) output from the motor 1220 through the inverter 1120 to DC voltage suitable for the main battery 1210, such that the main battery 1210 is charged with the DC voltage. When the vehicle 1200 is in the traveling mode, the inverter 1120 converts the direct current stepped up by the converter 1110 to a prescribed alternating current, and supplies the motor 1220 with the converted power to drive the motor 1220. In the regenerative mode, the inverter 1120 converts the AC output from the motor 1220 into direct current, and outputs the direct current to the converter 1110.

Figure 10:
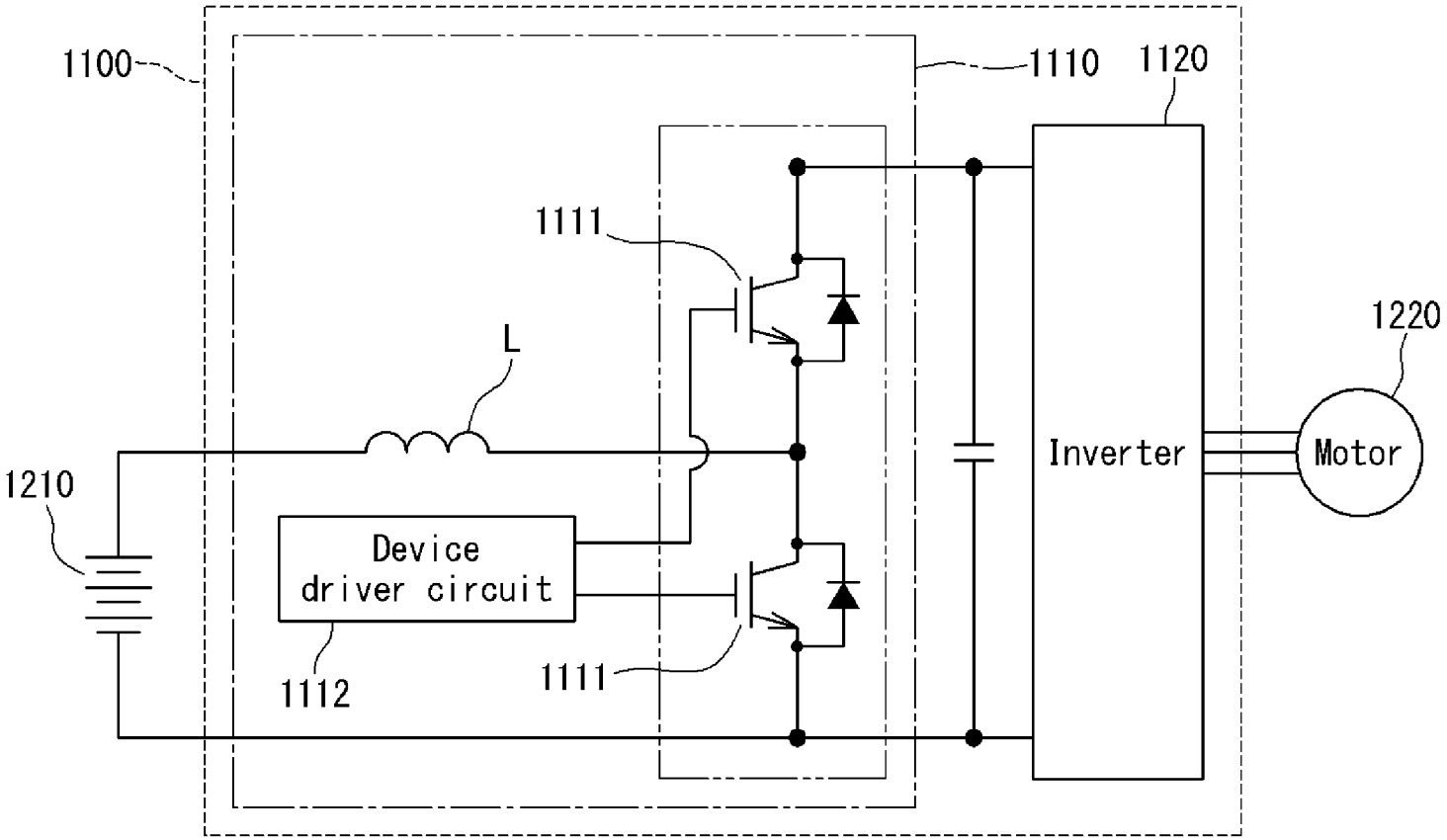
FIG. 10 is a schematic circuit diagram showing one example of a power converter apparatus of the present invention including the converter of the present invention.

As shown in FIG. 10, the converter 1110 includes a plurality of switching elements 1111, a driver circuit 1112 that controls operations of the switching elements 1111, and a reactor L. The converter 1110 converts (here, performs step up and down) the input voltage by repetitively performing ON/OFF (switching operations). As the switching elements 1111, power devices such as FETs and IGBTs are used. The reactor L uses a characteristic of a coil that disturbs a change of current which flows through the circuit, and hence has a function of making the change smooth when the current is increased or decreased by the switching operation. The reactor L is the reactor according to any of the first to sixth embodiments and Variations 1 to 2. Since the reactor with excellent heat dissipating characteristic is included, the power converter apparatus 1100 and the converter 1110 also exhibit excellent heat dissipating characteristic.

The vehicle 1200 includes, in addition to the converter 1110, a power supply apparatus-use converter 1150 connected to the main battery 1210, and an auxiliary power supply-use converter 1160 connected to a sub-battery 1230 serving as a power supply of auxiliary equipment 1240 and to the main battery 1210, to convert a high voltage of the main battery 1210 to a low voltage. The converter 1110 representatively performs DC-DC conversion, whereas the power supply apparatus-use converter 1150 and the auxiliary power supply-use converter 1160 perform AC-DC conversion. Some types of the power supply apparatus-use converter 1150 perform DC-DC conversion. The power supply apparatus-use converter 1150 and the auxiliary power supply-use converter 1160 each may be structured similarly to the reactor according the first to sixth embodiments and Variations 1 and 2, and the size and shape of the reactor may be changed as appropriate. Further, the reactor according to any of the foregoing first to sixth embodiments and Variations 1 and 2 may be used as a converter that performs conversion for the input power and that performs only stepping up or stepping down.

Note that the present invention is not limited to the embodiments described above, and can be practiced as being modified as appropriate within a range not departing from the gist of the present invention.

For example, it is possible to employ the mode in which the sealing resin is interposed between the coil and the bottom plate portion, in addition to the resin forming the resin mold portion, or the mode in which the coil and the bottom plate portion are integrated by the sealing resin. In these modes, since the relative position between the coil and the bottom plate portion can be maintained by the sealing resin that is present at least between the coil and the bottom plate portion, the heat of the coil can be transferred to the outside of the case via the bottom plate portion in an excellent manner. Further, subjecting the bottom plate portion to the surface roughening treatment, the contact area between the sealing resin and the bottom plate portion can be increased, whereby the heat dissipating characteristic can be further enhanced. In other possible mode, when the magnetic core is a mold product formed by the composite material or the powder magnetic core, the magnetic core can be assembled to the coil with ease. Therefore, the resin mold portion may be dispensed with, and the coil, the magnetic core, and the bottom plate portion may be fixed to one another by an adhesive agent, or they may be stored in the case and thereafter fixed by a sealing resin or the like as described above.

INDUSTRIAL APPLICABILITY

The reactor of the present invention can be used as a constituent component of a power converter apparatus, such as a DC-DC converter mounted on a vehicle such as a hybrid vehicle, a plug-in hybrid vehicle, an electric vehicle, and a fuel cell vehicle, and a converter of an air conditioner. The reactor-use coil component of the present invention can be used as a constituent component of the reactor used for the power converter apparatus.

REFERENCE SIGNS LIST

1A, 1B, 1C: REACTOR
2, 2B, 2C: COIL
2*w*: WIRE
2*a*, 2*b*: COIL ELEMENT
2*r*: COUPLE PORTION
20A, 20C: COIL COMPONENT
21: RESIN MOLD PORTION
3: MAGNETIC CORE
31, 31*a*, 31*b*: INNER CORE PORTION
31*e*: END FACE
32: OUTER CORE PORTION
32*a*, 32*b*: DIVISIONAL MOLD PRODUCT
32*c*: INTEGRAL MOLD PRODUCT
320, 320*c*: JOINING FACE
321: COIL COVERING FACE
322: PEDESTAL COVERING FACE
4A, 4B, 4C: CASE
40, 40B, 40C: BOTTOM PLATE PORTION
40*i*: INNER BOTTOM FACE
40*o*: OUTER BOTTOM FACE
41: WALL PORTION
42, 42C: LID PORTION
42*h*: WIRE HOLE
42*b*: BOLT HOLE
43: CONTAINER
400, 410: ATTACHING PORTION
401, 401*a*, 401*b*, 401*c*: HEAT DISSIPATING PEDESTAL PORTION
401*e*: END FACE
401*s*: SIDE FACE
402: SUPPORTING FACE
5: LID-SIDE PEDESTAL PORTION
50: FIXING HOLE
100, 110: BOLT
1100: POWER CONVERTER APPARATUS
1110: CONVERTER
1111: SWITCHING ELEMENT
1112: DRIVER CIRCUIT
L: REACTOR
1120: INVERTER
1150: POWER SUPPLY APPARATUS-USE CONVERTER
1160: AUXILIARY POWER SUPPLY-USE CONVERTER
1200: VEHICLE
1210: MAIN BATTERY
1220: MOTOR
1230: SUB-BATTERY
1240: AUXILIARY EQUIPMENT
1250: WHEELS

The invention claimed is:

1. A reactor comprising:
a sleeve-like coil;
a magnetic core that is disposed inside and outside the coil to form a closed magnetic path;
a resin mold portion formed by an insulating resin, the resin mold portion covering at least part of an outer circumference of the coil to retain a shape of the coil; and
a case that stores the coil and the magnetic core and the resin mold portion, wherein
at least part of the magnetic core is formed by a composite material that contains magnetic substance powder and resin,
the case includes:
a bottom plate portion that is formed by a non-magnetic metal material, an assembled product made up of the coil and the magnetic core being disposed on the bottom plate portion; and
a wall portion that is an independent member from the bottom plate portion, the wall portion being attached to the bottom plate portion to surround the assembled product,
the resin mold portion integrally retains the coil and the bottom plate portion, and the magnetic core includes:

an inner core portion that is disposed inside the coil so that at least one of both axial end faces of the inner core portion is not covered by the resin mold portion and exposed outside; and an outer core portion that is in a shape conforming to a space formed by an inner circumferential face of the case and an outer circumferential face of the resin mold portion, the outer core portion has a part that is coupled to at least one of both axial end faces of the inner core portion.

2. The reactor according to claim 1, wherein the coil includes a juxtaposed pair of sleeve-like coil elements, and the magnetic core is formed by the composite material.

3. The reactor according to claim 1, wherein the coil includes the sleeve-like coil element by one in number, in the magnetic core, at least part of a portion disposed on an outer circumferential side of the coil element is formed by the composite material, and in the outer circumference of the coil element, a portion covered by the composite material is covered by the resin forming the resin mold portion.

4. The reactor according to claim 1, wherein in the bottom plate portion, at least part of a region covered by the resin mold portion is subjected to a surface roughening treatment.

5. The reactor according to claim 1, wherein the bottom plate portion further includes a heat dissipating pedestal portion that is provided with a supporting face conforming to an outer circumferential face of the coil.

6. The reactor according to claim 1, further comprising:

a lid portion that covers an opening portion of the wall portion; and a lid-side pedestal portion that is formed by a non-magnetic metal material and that is integrally retained with the coil by the resin forming the resin mold portion, the lid portion being attached to the lid-side pedestal portion.

7. The reactor according to claim 1, wherein the case includes the lid portion that is integrally molded with the wall portion.

8. The reactor according to claim 1, wherein in the magnetic core, an inner core portion disposed inside the coil is integrally retained with the coil by the resin forming the resin mold portion.

9. The reactor according to claim 1, wherein the coil is stored in the case such that an axis of the coil is parallel to an outer bottom face of the bottom plate portion.

10. The reactor according to claim 1, wherein the case integrally includes an attaching portion for fixing the reactor to an installation target.

11. A converter comprising the reactor according to claim 1.

12. A power converter apparatus comprising the converter according to claim 11.

13. A reactor-use coil component used for the reactor according to claim 1, the reactor-use coil component comprising:

the sleeve-like coil;

the bottom plate portion that is formed by a non-magnetic metal material, an assembled product made up of the coil and the magnetic core being disposed on the bottom plate portion in the case; and the resin mold portion that is formed by the insulating resin, and that covers at least part of an outer circumference of the coil to retain a shape of the coil, the resin mold portion integrally retaining the coil and the bottom plate portion.

* * * * *